US011394114B2

(12) United States Patent
Boutayeb et al.

(10) Patent No.: US 11,394,114 B2
(45) Date of Patent: Jul. 19, 2022

(54) DUAL-POLARIZED SUBSTRATE-INTEGRATED 360° BEAM STEERING ANTENNA

(71) Applicant: HUAWEI TECHNOLOGIES CO., LTD., Guangdong (CN)

(72) Inventors: Halim Boutayeb, Kanata (CA); Xin Feng, Kanata (CA); Wenyao Zhai, Kanata (CA); Fayez Hyjazie, Ottawa (CA); Wen Tong, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 33 days.

(21) Appl. No.: 17/130,364

(22) Filed: Dec. 22, 2020

(65) Prior Publication Data

US 2022/0200145 A1 Jun. 23, 2022

(51) Int. Cl.

| | |
|---|---|
| ***H01Q 13/00*** | (2006.01) |
| ***H01Q 21/24*** | (2006.01) |
| ***H01Q 3/22*** | (2006.01) |

(52) U.S. Cl.
CPC ..... *H01Q 3/22* (2013.01); *H01Q 13/00* (2013.01)

(58) Field of Classification Search
CPC .. H01Q 1/38; H01Q 3/22; H01Q 3/24; H01Q 3/242; H01Q 13/00; H01Q 21/00;
(Continued)

(56) References Cited

U.S. PATENT DOCUMENTS 7,075,494 B2 * 7/2006 Sergey ..... H01Q 21/0075 343/770
7,202,832 B2 * 4/2007 Wang ..... H01Q 21/005 343/770

(Continued)

FOREIGN PATENT DOCUMENTS

CN 108493628 A 9/2018
CN 109066065 A 12/2018

(Continued)

OTHER PUBLICATIONS

Boutayeb, h. et al., 28GHz Dual Polarized beam steering antenna with substrate integrated frequency selective structure, 2019, 13th European Conference on Antennas and Propagation (EuCAP), Jun. 20, 2019.

(Continued)

*Primary Examiner* — Tho G Phan
(74) *Attorney, Agent, or Firm* — BCF LLP

(57) ABSTRACT

The disclosed structures and methods are directed to transmission and reception of a radio-frequency (RF) wave. An antenna comprises a stack-up structure having a first control layer, a second control layer, a first and a second parallel-plate waveguides, and a plurality of through vias. The antenna further comprises a first central port and a second central port being configured to radiate RF wave into the two parallel-plate waveguides independently; vertical-polarization peripheral radiating elements integrated with the first control layer and configured to radiate RF wave in vertical polarization; and horizontal-polarization peripheral radiating elements integrated with the second control layer and configured to radiate RF wave in horizontal polarization. A central port for transmission of RF wave into the stack-up structure of the antenna is also provided. Each vertical-polarization peripheral radiating element is collocated with one of the horizontal-polarization peripheral radiating ele- (Continued)

ment such that they cross each other, and that a RF wave radiation beam may be steered at an angle of 0 to 360 degrees in the plane of the stack-up structure, around the central port.

20 Claims, 16 Drawing Sheets

(58) Field of Classification Search
CPC ..... H01Q 1/48; H01Q 21/06; H01Q 21/24; H01Q 9/04
See application file for complete search history.

(56) References Cited

U.S. PATENT DOCUMENTS

| | | | | |
|---|---|---|---|---|
| 7,808,439 | B2 * | 10/2010 | Yang | H01Q 13/22 343/770 |
| 9,246,232 | B2 * | 1/2016 | Sauleau | H01Q 13/22 |
| 9,397,395 | B2 | 7/2016 | Boutayeb | |
| 9,490,535 | B2 | 11/2016 | Boutayeb et al. | |
| 9,502,765 | B2 | 11/2016 | Boutayeb et al. | |
| 10,424,847 | B2 | 9/2019 | Isom et al. | |
| 10,454,184 | B2 * | 10/2019 | Boutayeb | H01Q 21/0031 |
| 10,468,780 | B1 | 11/2019 | Milroy et al. | |
| 10,644,411 | B2 * | 5/2020 | Saberin | H01Q 19/138 |
| 10,854,996 | B2 | 12/2020 | Boutayeb et al. | |
| 2004/0027291 | A1 | 2/2004 | Zhang et al. | |
| 2009/0073075 | A1 | 3/2009 | Irion et al. | |
| 2010/0040955 | A1 | 2/2010 | Vouvakis | |
| 2010/0245204 | A1 | 9/2010 | Lee et al. | |
| 2012/0146869 | A1 | 6/2012 | Holland et al. | |
| 2016/0079672 | A1 | 3/2016 | Cerreno | |
| 2019/0081411 | A1 | 3/2019 | Isom et al. | |
| 2020/0161777 | A1 | 5/2020 | Boutayeb et al. | |
| 2020/0403324 | A1 * | 12/2020 | Ying | H01Q 9/40 |

FOREIGN PATENT DOCUMENTS

| | | | |
|---|---|---|---|
| CN | 110880632 | A | 3/2020 |
| WO | 2009116934 | A1 | 9/2009 |
| WO | 2020177713 | A1 | 9/2020 |

OTHER PUBLICATIONS

Boutayeb, H. et al., Beam switching dual polarized antenna array with reconfigurable radial waveguide power dividers, IEEE Transactions on Antennas and Propagation, Vo. 65, No. 4, Apr. 2017, p. 1807-1814.

Boutayeb, H. et al., New reconfigurable power divider based on radial waewguide and cylindrical electromagnetic band cap structure for low power and low cost smart antenna systems, IEEE AP-S 2014, p. 1457-1458.

Xu, J. et al., A Q-Band low-profile dual circularly polarized array antenna incorporating linearly polarized substrate integrated waveguide-Fed patch subarrays, IEEE Transactions on Antennas and Propagation, Oct. 31, 2017.

International Search Report and Written Opinion issued in co-pending International application No. PCT/CN2021/138395 dated Feb. 24, 2022.

* cited by examiner

DUAL-POLARIZED SUBSTRATE-INTEGRATED 360° BEAM STEERING ANTENNA

CROSS-REFERENCE TO RELATED APPLICATION

The present application contains subject matter related to U.S. application Ser. No. 16/294,404, entitled "DUAL-POLARIZED SUBSTRATE-INTEGRATED BEAM STEERING ANTENNA" filed on Mar. 6, 2019, published Sep. 10, 2020 under publication number 2020/0287297, and issued Dec. 1, 2020 (U.S. Pat. No. 10,854,996).

FIELD OF THE INVENTION

The present invention generally relates to the field of wireless communications and, in particular, to antenna systems configured to transmit and receive a wireless signal to and from different directions.

BACKGROUND

Antenna systems having wide steering angles and high directivity are sought after in wireless communications applications. Planar phased array antennas do provide the capability of wide steering angles, but the directivity of such antennas has a tendency to decrease with increases in the steering angle of the directed beam. Planar phased array antennas may also have blind angular regions and are expensive due to fabrication processes and the costs associated with phase shifters.

SUMMARY

An object of the present disclosure is to provide a dual-polarized substrate-integrated 360° beam steering antenna for transmission and reception of a radio-frequency (RF) wave. The antenna is configured to transmit and receive a wireless signal in and from different directions.

In accordance with this objective, an aspect of the present disclosure provides an antenna for transmission of a radio-frequency (RF) wave, the antenna comprising a stack-up structure. The structure has a first control layer, a second control layer that is approximately parallel to the first control layer, a first parallel-plate waveguide and a second parallel-plate waveguide located between the first control layer and the second control layer, with the first parallel-plate waveguide and the second parallel-plate waveguide being approximately parallel to each other and to the first control layer and the second control layer. The structure further comprises a plurality of through vias operatively connecting the first control layer and the second control layer to center RF and direct current (DC) ground planes, one or a plurality of hollow portions through the stack-up structure; and a RF connector being proximate to a hollow portion, and configured to deliver a RF signal to a first central port located on the first control layer and a second central port located on the second control layer. The first central port is configured to radiate the RF wave into the first parallel-plate waveguide, and the second central port is configured to radiate the RF wave into the second parallel-plate waveguide. The structure further comprises vertical-polarization peripheral ports integrated with the first control layer and configured to radiate the RF wave in vertical polarization from the first parallel-plate waveguide, and horizontal-polarization peripheral ports integrated with the second control layer and configured to radiate the RF wave in horizontal polarization from the second parallel-plate waveguide, each one of the vertical-polarization peripheral ports being collocated with one of the horizontal-polarization peripheral ports such that they cross each other, and that a RF wave radiation beam may be steered at an angle of 0 to 360 degrees in the plane of the stack-up structure, around the first and second central port.

In at least one embodiment, the stack-up structure has an approximately circular shape.

In at least another embodiment, the stack-up structure has an approximately elliptical shape.

The antenna may further comprise a pair of frequency selective structures having frequency selective elements, each frequency selective structure being located partly on a corresponding one of the first control layer or the second control layer, each frequency selective element being configured: to allow propagation of the RF wave in one of the first parallel-plate waveguide or the second parallel-plate waveguide when the frequency selective element is in one operational mode and to forbid propagation of the RF wave in one of the first parallel-plate waveguide or the second parallel-plate waveguide when the frequency selective element is in another operational mode In at least one embodiment, the antenna further comprises a pair of bent line structures having bent lines, with each bent line structure being located partly on a corresponding one of the first control layer or the second control layer. Each bent line is configured to bypass the one or the plurality of hollow portions of the stack-up structure. Each bent line located on the first control layer is configured to couple the first parallel-plate waveguide to one or a plurality of vertical-polarization peripheral ports, and each bent line located on the second control layer is configured to couple the second parallel-plate waveguide to one or a plurality of horizontal-polarization peripheral ports.

In at least one embodiment, all bent lines in each bent line structure have approximately the same electrical length.

Each frequency selective element may comprise a radial stub configured to choke high frequencies while passing low frequencies, and a switchable element operatively connected to the radial stub and one of the first parallel-plate waveguide or the second parallel-plate waveguide by one or two of the plurality of through vias, with the switchable element being configured to selectively control operational mode of the frequency selective element.

In at least one embodiment, the antenna may be configured to steer the RF wave radiation beam by selectively switching between one and the other operational mode of the frequency selective elements and by selectively switching on a first plurality of frequency selective elements and switching off a second plurality of frequency selective elements.

The frequency selective elements of at least one frequency-selective structure of the pair of frequency-selective structures may be arranged in rows, each frequency selective element in each row being located at approximately equal distance from the central port located on the same surface as the at least one frequency-selective structure of the pair of frequency selective structures.

Each switchable element may further comprise a connector stub, the connector stub being configured to operatively connect the switchable element to the one or two of the plurality of through vias, and at least certain of the frequency selective elements have a connector stub being shorter than connector stubs of the other frequency selective elements.

In at least one embodiment, the frequency selective elements of at least one frequency-selective structure of the pair of frequency-selective structures may be arranged in three rows approximately concentric around the central port located on the same surface as the at least one frequency-selective structure of the pair of frequency selective structures.

The frequency selective elements of at least one frequency-selective structure of the pair of frequency-selective structures may be arranged in at least two rows approximately concentric around the central port located on the same surface as the at least one frequency-selective structure of the pair of frequency selective structures, and each switchable element in at least one of the at least two rows may further comprise a connector stub, the connector stub being configured to operatively connect the switchable element to one of the plurality of through vias, and each switchable element in at least another one of the at least two rows may further comprise a connector stub, the connector stub configured to operatively connect the switchable element to two of the plurality of through vias.

In at least one embodiment, at least two of the frequency selective elements are operatively connected to one DC circuit and are operated simultaneously.

In another embodiment, the antenna is one of a plurality of antennas, and frequency selective elements of each one of the plurality of antennas are configured to be selectively switched ON and OFF, such that the frequency selective elements of each one of the plurality of antennas may operate synchronously or asynchronously with the frequency selective elements of the other ones of the plurality of antennas.

The antenna, when one of a plurality of antennas, may be further configured to steer the RF wave radiation beam, the steering being provided by selectively switching on a first plurality of frequency selective elements of the antenna and switching off a second plurality of frequency selective elements of the antenna.

Protective layers may be located between neighboring antennas.

A RF power divider may be configured to be inserted through one of the one or the plurality of hollow portions, and to electrically and mechanically attach to the RF connector of each one of the plurality of antennas.

Another aspect of the present disclosure provides an antenna for transmission of a radio-frequency (RF) wave, with the antenna comprising a stack-up structure having: a first control layer; a second control layer being approximately parallel to the first control layer; a first parallel-plate waveguide and a second parallel-plate waveguide located between the first control layer and the second control layer, the first parallel-plate waveguide and the second parallel-plate waveguide being approximately parallel to each other and to the first control layer and the second control layer; a plurality of through vias operatively connecting the first control layer and the second control layer to center RF and direct current (DC) ground planes; and a RF connector configured to deliver a RF signal to a first central port located on the first control layer and a second central port located on the second control layer. The first central port may be configured to radiate the RF wave into the first parallel-plate waveguide, and the second central port may be configured to radiate the RF wave into the second parallel-plate waveguide. The structure may further comprise vertical-polarization peripheral ports integrated with the first control layer and configured to radiate the RF wave in vertical polarization from the first parallel-plate waveguide, and horizontal-polarization peripheral ports integrated with the second control layer and configured to radiate the RF wave in horizontal polarization from the second parallel-plate waveguide, each one of the vertical-polarization peripheral ports being collocated with one of the horizontal-polarization peripheral ports such that they cross each other. The antenna may further comprise a pair of bent line structures having bent lines, with each bent line structure being located partly on a corresponding one of the first control layer or the second control layer. Each bent line located on the first control layer may be configured to couple the first parallel-plate waveguide to one or a plurality of vertical-polarization peripheral ports. Each bent line located on the second control layer may be configured to couple the second parallel-plate waveguide to one or a plurality of horizontal-polarization peripheral ports.

In at least one embodiment, each bent line may be made of microstrip lines with a width optimized to ensure impedance matching of the antenna including transition of one of the first parallel-plate waveguide or the second parallel-plate waveguide to the bent line.

In at least another embodiment, all bent lines have the same electrical length.

BRIEF DESCRIPTION OF THE FIGURES

The features and advantages of the present disclosure will become apparent from the following detailed description, taken in combination with the appended drawings, in which.

Figure 1A:
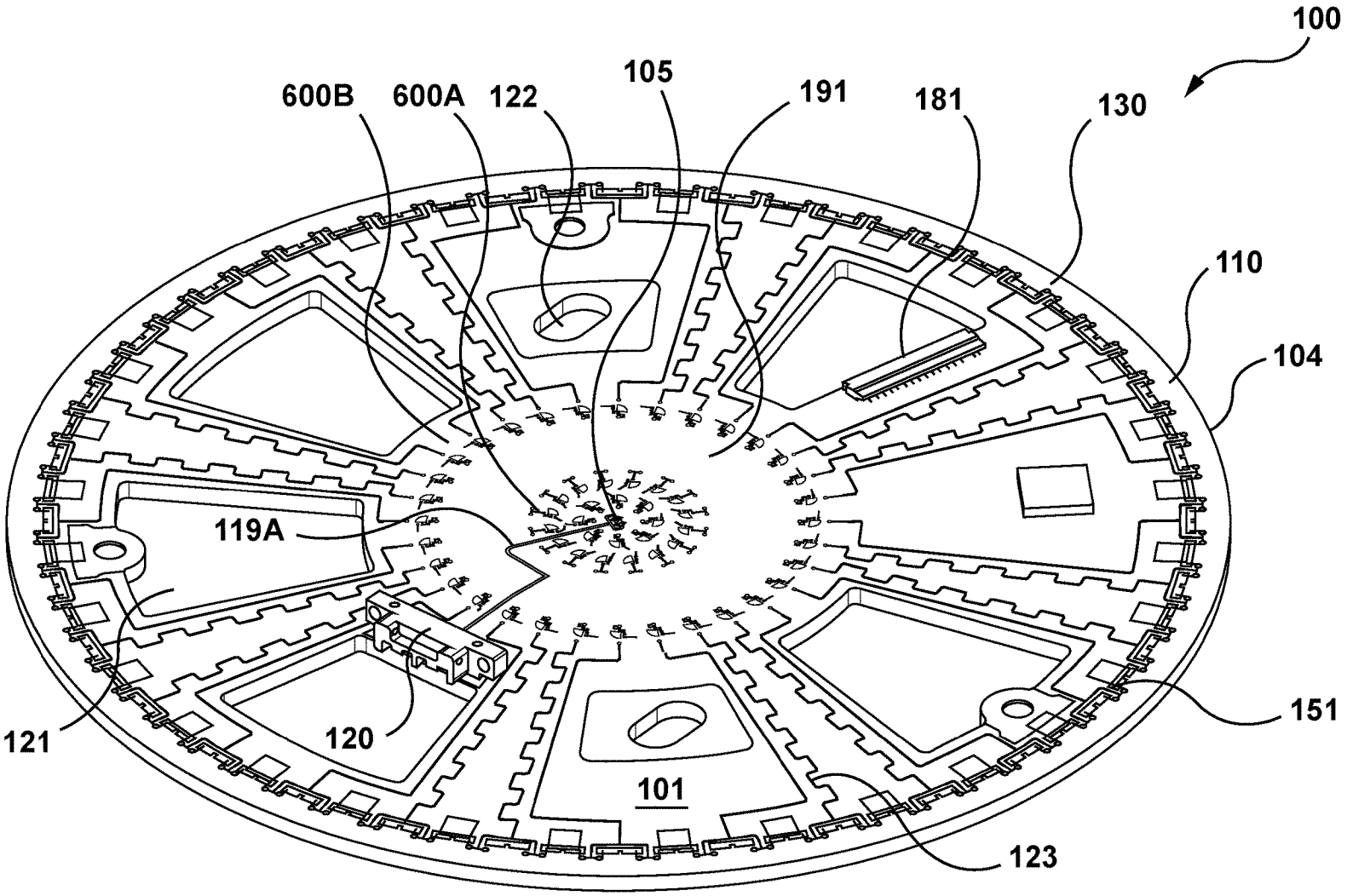
FIG. 1A depicts a top perspective view of a beam steering antenna, in an embodiment of the present technology.

It is to be understood that throughout the appended drawings and corresponding descriptions, like features are identified by like reference characters. Furthermore, it is also to be understood that the drawings and ensuing descriptions are intended for illustrative purposes only and that such disclosures are not intended to limit the scope of the claims.

DETAILED DESCRIPTION

The instant disclosure is directed to addressing the deficiencies of current phased array antennas implementations. The instant disclosure describes a 360° beam steering antenna (also referred to herein as "antenna"), having two parallel-plate waveguides and integrated frequency selective structures (FSSs). The antenna is configured to provide increased ranges of steering angles for both vertical and horizontal polarizations while also providing high directivity (of about 13 dB to 16 dB) with low variation (about 10%) for various steering angle ranges.

The technology described herein may be embodied in a variety of different electronic devices (EDs) including base stations (BSs), user equipment (UE), etc.

It will be appreciated that the electromagnetic wave that is one of propagated by and received by the disclosed antenna configuration may be within a radio frequency (RF) range (RF wave). In some embodiments, the RF wave may be a millimeter wave range and below (e.g., operating frequencies of about 10 GHz to about 300 GHz). In other embodiments, the RF wave may be in a microwave range (e.g., about 1 GHz to about 10 GHz).

The antenna structure as described herein may be configured to operate in a millimeter wave range and below (i.e., between 10 GHz and about 300 GHz). It should be understood, however, that the presented antenna structure may also operate at other RF range frequencies. Moreover, the antenna structure, as described herein may, in various embodiments, be formed from appropriate features of a multilayer printed circuit board (PCB). The features of the antenna structure may be formed by etching of conductive layers and manufacturing of vias along with other such conventional PCB manufacturing techniques. Such a PCB implementation may be suitably compact for inclusion in electronic devices such as BS and UEs. Mature manufacturing techniques known in the PCB field may be used to provide suitable cost-effective volume production.

As used herein, the term "about" or "approximately" refers to a +/−10% variation from the nominal value. It is to be understood that such a variation is always included in a given value provided herein, whether or not it is specifically referred to.

As referred to herein, the term "guided wavelength" refers to a wavelength of propagation of an RF wave to provide propagation of a transverse electromagnetic mode (TEM) inside a corresponding waveguide. In addition, as referred to herein, the term "via" refers to an electrical connection providing electrical connectivity between the physical layers of an electronic circuit.

Unless otherwise defined, all technical and scientific terms used herein have the same meaning as commonly understood by one of ordinary skill in the art to which the described embodiments appertain to.

In accordance with the contemplated embodiments of the instant disclosure, the antenna structure, as described herein, may be configured to steer the angle of RF beam transmission and reception by actuating a plurality of Frequency Selective Elements (FSEs) integrated with two parallel-plate waveguides. In particular, the antenna structure may be configured to switch and operate to an "ON" state based on a first plurality of FSEs and operate to switch to an "OFF" state based on a second plurality of FSEs.

Compared to conventional planar phased array antennas, the embodiments of the instantly disclosed antenna structure, may provide any or all of a wider steering angle range (e.g., at least 180 degrees and up to 360 degrees), while exhibiting lower losses and a lower power consumption. Furthermore, the disclosed antenna structure may be integrated with a substrate of a stacked-up arrangement that may be configured to operate in vertical and horizontal polarizations as well as radiate and receive multiple RF beams. In addition, as compared to the conventional planar phased array antennas, the disclosed antenna structure may be less expensive to manufacture in view of the implementation of switchable elements instead of phase shifters to steer the beam angle, and the use of a multilayer PCB process when fabricating the antenna.

Figure 2A:
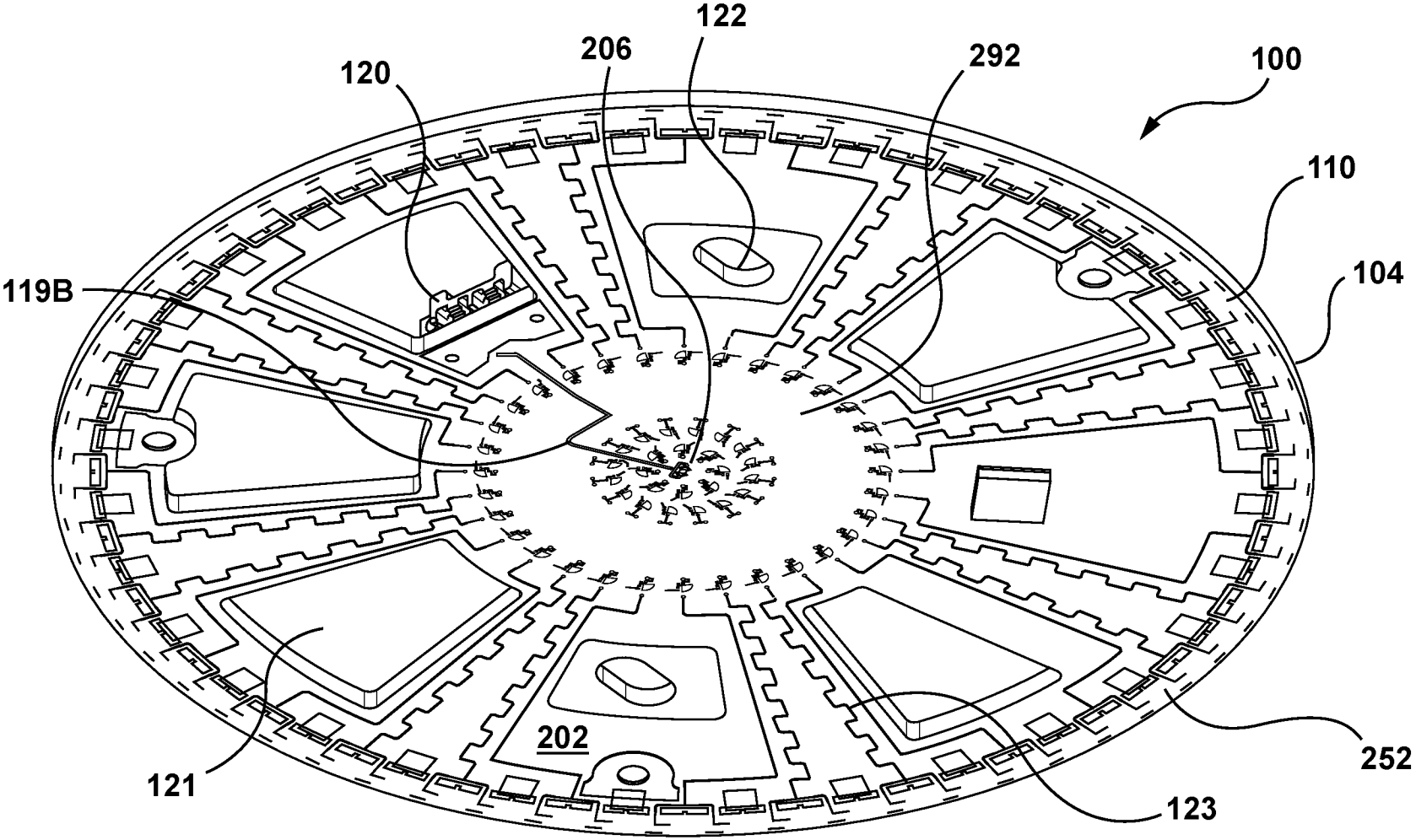
FIG. 2A depicts an underside perspective view of the antenna of FIG. 1A.

Referring now to drawings, FIG. 1A depicts a perspective top view of the structure of antenna 100, in an embodiment of the present technology, and FIG. 2A depicts an underside (i.e., bottom) perspective view of antenna 100 of FIG. 1A, in an embodiment of the present technology.

As shown, antenna 100 comprises a stack-up structure 110 having two control layers: a first control layer 101 (referred to herein as "first control circuit layer") and a second control layer 202 (referred to herein as "second control circuit layer"). Antenna 100 further comprises central port 105 disposed on the top, central port 206 disposed on the underside, and two FSS 191, 292.

FIGS. 1A and 2A indicate that stack-up structure 110 has an approximately circular shape having a circumferential edge 104. It is contemplated that stack-up structure 110 may encompass other shapes that may be suitably used for radiation of the RF wave therefrom, with a beam that may be steered at an angle of 0 to 360 degrees in the plane of the stack-up structure. For example, and without limitation, the shape may be approximately elliptical. The disclosed shape of antenna 100 provides an exemplary structure of an effective configuration, but is not intended to be limiting, as other antenna shapes may be applied in accordance with the inventive concepts disclosed heretofore.

FIGS. 1A and 2A further indicate that stack-up structure 110 has one or several hollow portions 121, and one or several holes 122. When stack-up structures 110 are stacked-up (as shown FIG. 8), and these holes are aligned, this alignment allows respectively to electrically feed RF connector 120 and DC connector 181, and to mechanically maintain (fixing and/or positioning) the stack-up structures 110 together.

The first control layer 101 of antenna 100 includes vertical-polarization peripheral ports 151 that are configured to receive and transmit RF waves in a vertical polarization. The vertical-polarization peripheral ports 151 are also referred to herein as vertical-polarization peripheral radiating elements 151, and are radiating elements, having vertical polarization, located as illustrated in FIG. 1A, on the periphery of the first control layer 101, distributed radially around the circumference of the first control layer 101, and proximate to circumferential edge 104 of antenna 100.

Figure 1B:
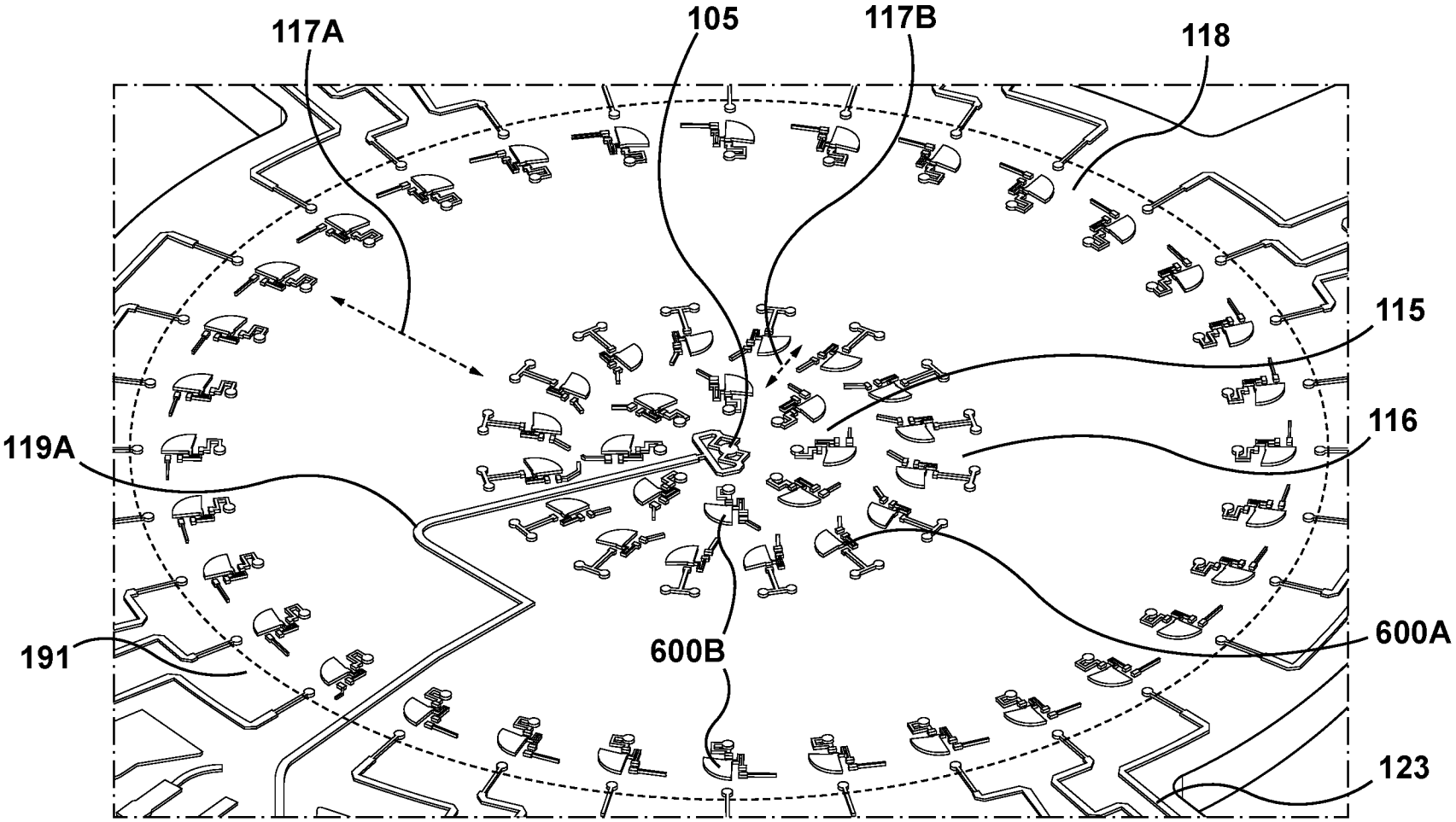
FIG. 1B provides an enlarged view of the center of the top perspective view of FIG. 1A.

The second control layer 202 of antenna 100 has horizontal-polarization peripheral ports 252, configured to receive and transmit RF waves in a horizontal polarization. The horizontal-polarization peripheral ports 252 are also referred to herein as horizontal-polarization peripheral radiating elements 252, and are radiating elements, having horizontal polarization, located as illustrated in FIG. 1B, on the periphery of the second control layer 202, distributed radially around the circumference of the second control layer 202, and proximate to circumferential edge 104 of antenna 100.

Figure 2B:
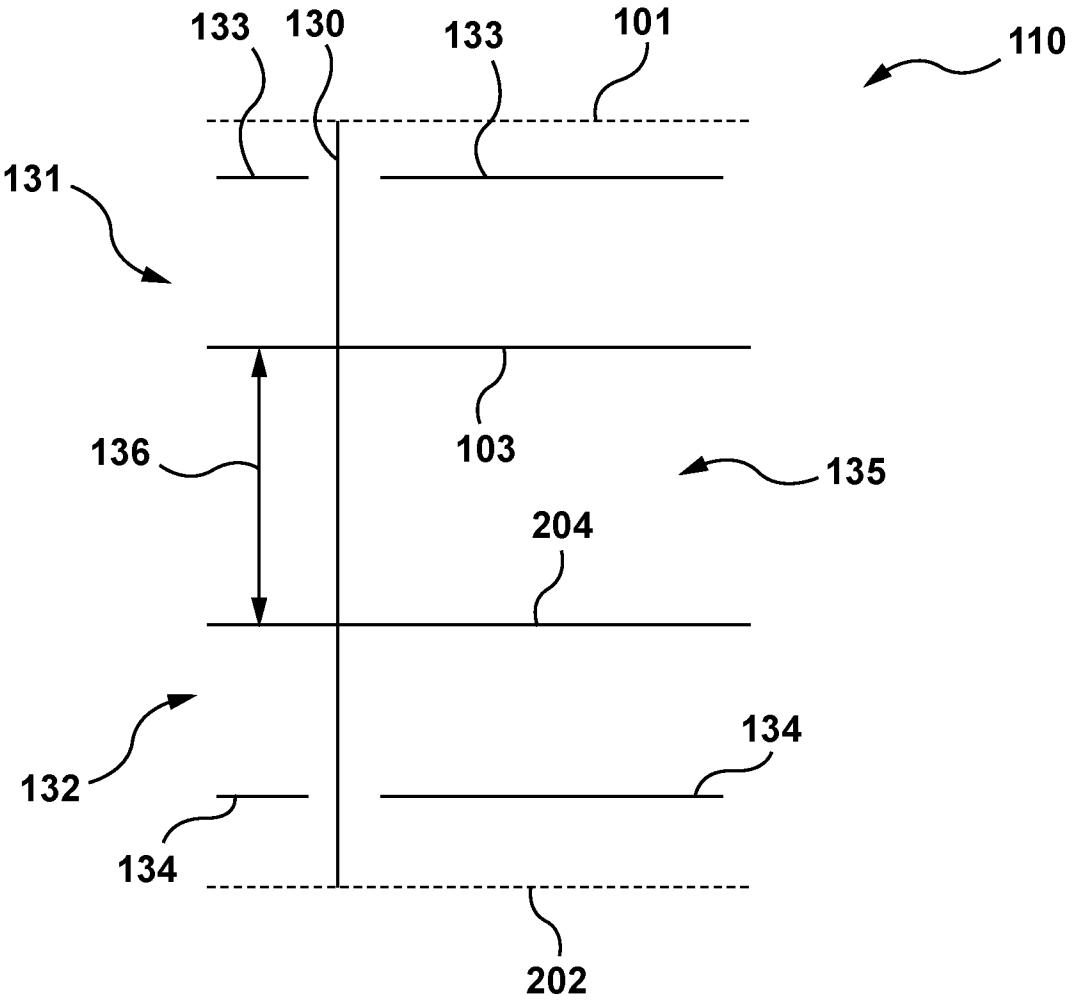
FIG. 2B depicts an enlarged partial cross section view of the stack-up structure of the antenna of FIG. 1A, in an embodiment of the present technology.

Referring now to FIG. 2B, stack-up structure 110 has a first parallel-plate waveguide 131 and a second parallel-plate waveguide 132, two ground layers 103, 204 and two metal plates 133, 134, as well as first control layer 101 and second control layer 202. The metal plates 133, 134 along with a first ground layer 103 and a second ground layer 204 form two parallel-plate waveguides 131, 132. In at least one embodiment, parallel-plate waveguides 131, 132 are filled with a waveguide dielectric material, such as, for example, a dielectric composite material. In some portions of stack-up structure 110, a layer of dielectric material may cover the metal plates 133, 134 on the sides of first control layer 101 and second control layer 202, respectively.

The first ground layer 103 and the second ground layer 204 are located between the first control layer 101 and second control layer 202. The ground layers 103, 204 are connected to an electrical ground.

In illustrated embodiments, the distance between first control layer 101 and second control layer 202 is about a quarter of the wavelength. The first ground layer 103 and the second ground layer 204 may be separated by a spacer. In some embodiments, there is a spacing 135 between the first ground layer 103 and the second ground layer 204. The spacing width 136 is such that the total distance between first control layer 101 and second control layer 202 is about a quarter of the wavelength. Such spacing width 136 may be preferable for integration and operation of vertical-polarization peripheral ports 151.

The first control layer 101 and second control layer 202 are connected to each other by through vias 130 located in various places of stack-up structure 110. The through vias 130 (also referred to herein as "vias") go all the way through stack-up structure 110 and various elements located on first control layer 101 and second control layer 202 of antenna 100 may be connected to vias 130. The vias 130 are operatively connected to ground layers 103, 204. As illustrated in FIG. 2B, via 130 may be approximately perpendicular to first control layer 101 and second control layer 202. It should be noted that first control layer 101 and second control layer 202 are electrically isolated from each other because vias 130 are connected to electrical grounds.

The stack-up structure 110 may be made of a PCB. The dielectric materials used in the stack-up structure 110 may be those known in the art of the PCB technology. Alternatively, the stack-up structure 110 may be made with metallic plates which may be assembled with a circuit board, or using LTCC or liquid crystal polymer (LCP) technology.

Referring again to FIGS. 1A and 2A, two central ports 105, 206 may be located at or near a center of stack-up structure 110, one on first control layer 101 and the other on second control layer 202, respectively. The center of stack-up structure 110 is defined herein to be located at approximately equal distances from any point of circumferential edge 104 of antenna 100. It should be understood that central ports 105, 206 may be located at any other part of stack-up structure 110. The central ports 105, 206 may be operatively connected to one common via 130.

The central ports 105, 206 may be designed for example as described in the cross-referenced application, using feeds and shoulder portions made for example of microstrip lines, as well as vias, and are configured to be sources of radiation of an RF wave. The RF wave may radiate radially from central ports 105, 206 into parallel-plate waveguides 131 and 132. The central ports 105, 206 are also configured to receive radiation from parallel-plate waveguides 131 and 132. Each central port 105, 206 is operatively connected to a corresponding RF connector 120 through respectively RF feeds (for example microstrip lines) 119A and 119B (also visible on FIG. 1B), which, in its turn, is operatively connected to an RF signal source operated by an RF controller (not shown). The RF connector 120 may be located proximate to a hollow portion 121. In some embodiments, there are two RF feeds 119A and 119B as represented, but a different number of RF feeds may be had between the central ports 105, 206 and the RF connector 120. In operation, RF signal is delivered from the RF connector 120 (as depicted in FIGS. 1A and 2A) through RF feeds 119A and 119B to a center point of respectively the central ports 105, 206. Leads deliver RF signal to vias positioned radially from the center point. Three portions of the vias, located inside stack-up structure 110, radiate RF wave into parallel-plate waveguides 131 and 132 (also visible on FIG. 2B). Complete description of central ports that may be used herein as central ports 105, 206, may be found in the cross-referenced application.

In order to be able to radiate efficiently at various steering angles 8, central ports 105, 206 may be optimized to provide similar gain for RF radiation in all of, or in most of, the directions, or in a broad radiating angle range. In some embodiments, central ports 105, 206 provide similar gain in a desired frequency range of antenna 100.

In operation, RF signal is delivered from RF connector 120 (as depicted in FIGS. 1A and 2A) through feeds 119A and 119B to respectively the central ports 105 and 206. It should be understood that although central ports 105, 206 may be different from each other, they may have similar configuration. A configuration may for example be as described in the cross-referenced application, and is not shown in the present disclosure.

Figure 3A:
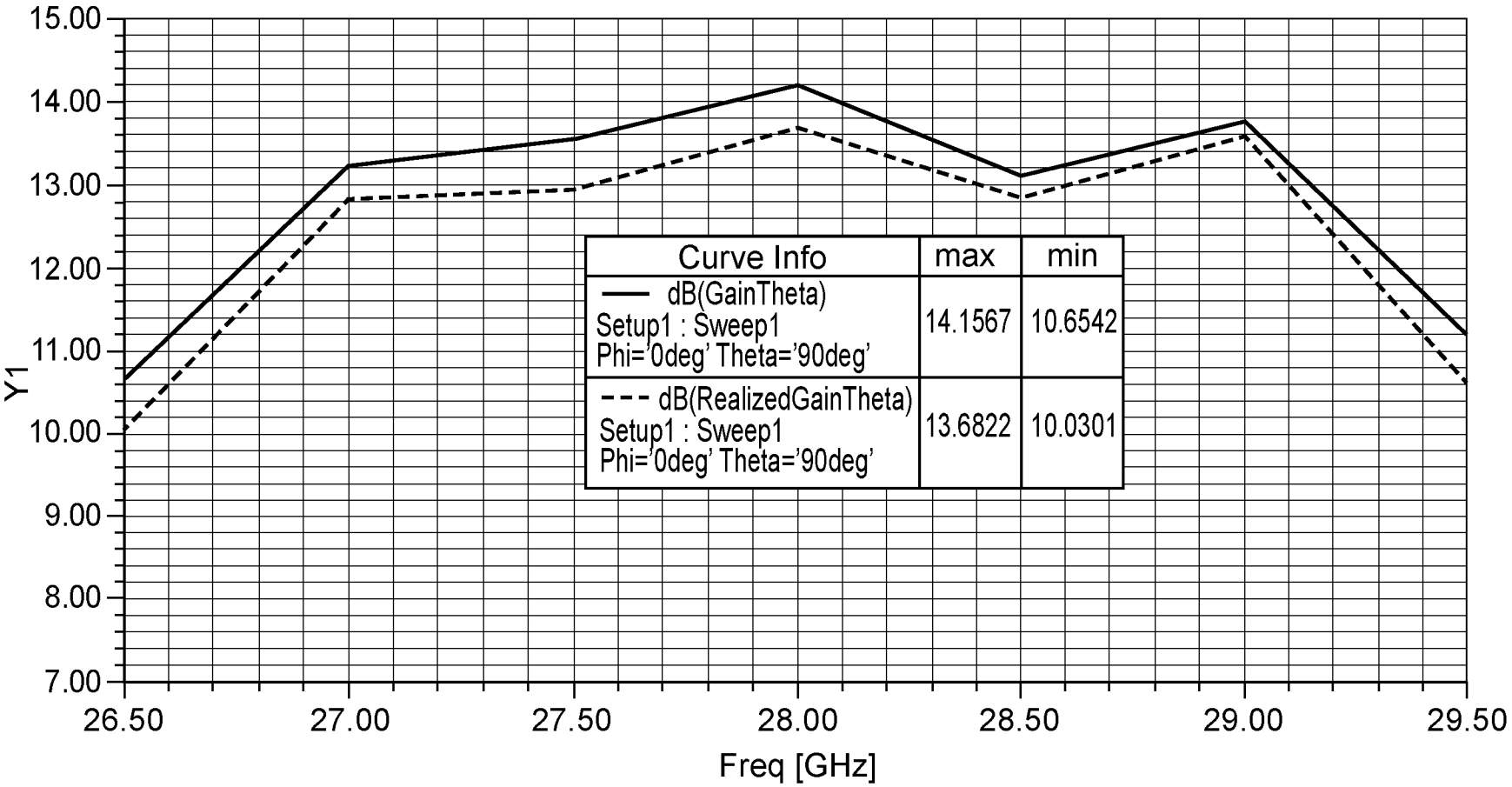
FIG. 3A illustrates the total gain of the antenna of FIG. 1A.

FIG. 3A illustrates the total gain of the antenna 100 versus frequency. It further illustrates the realized gain, as the total gain minus the return loss. The gain is more than 13 dB between 27 GHz to 29 GHz, providing evidence that antenna 100 in the disclosed embodiment offers high gain in a broad frequency band.

Figure 3B:
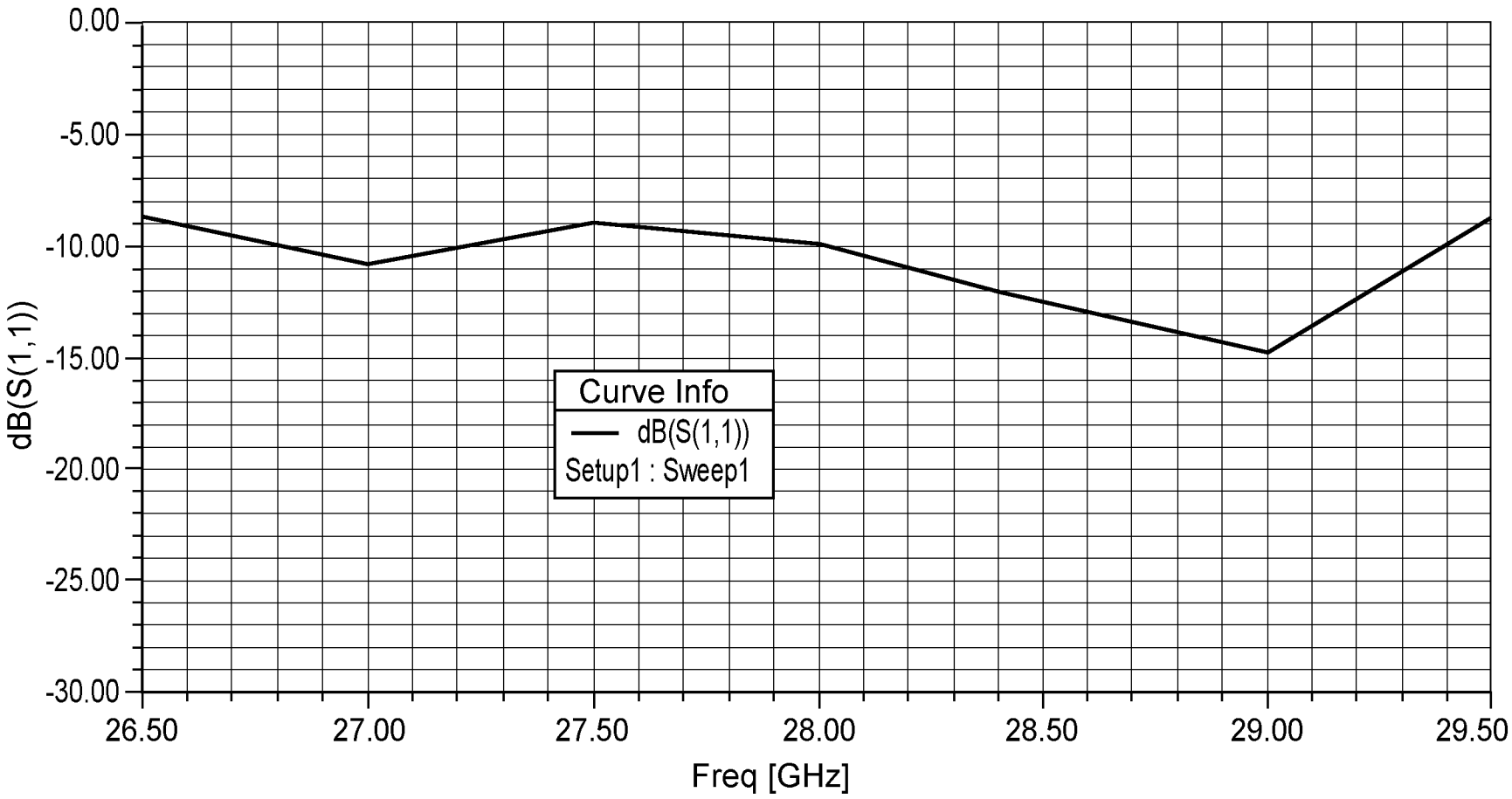
FIG. 3B illustrates the reflection coefficient (i.e., $S_{11}$-parameter) of the antenna of FIG. 1A.

FIG. 3B illustrates the return loss (or reflection coefficient) of antenna 100 versus frequency. The return loss is about −10 dB in the frequency band between 27 GHz-29 GHz, providing evidence that antenna 100 in the disclosed embodiment is well matched in a broad frequency band.

Figure 3C:
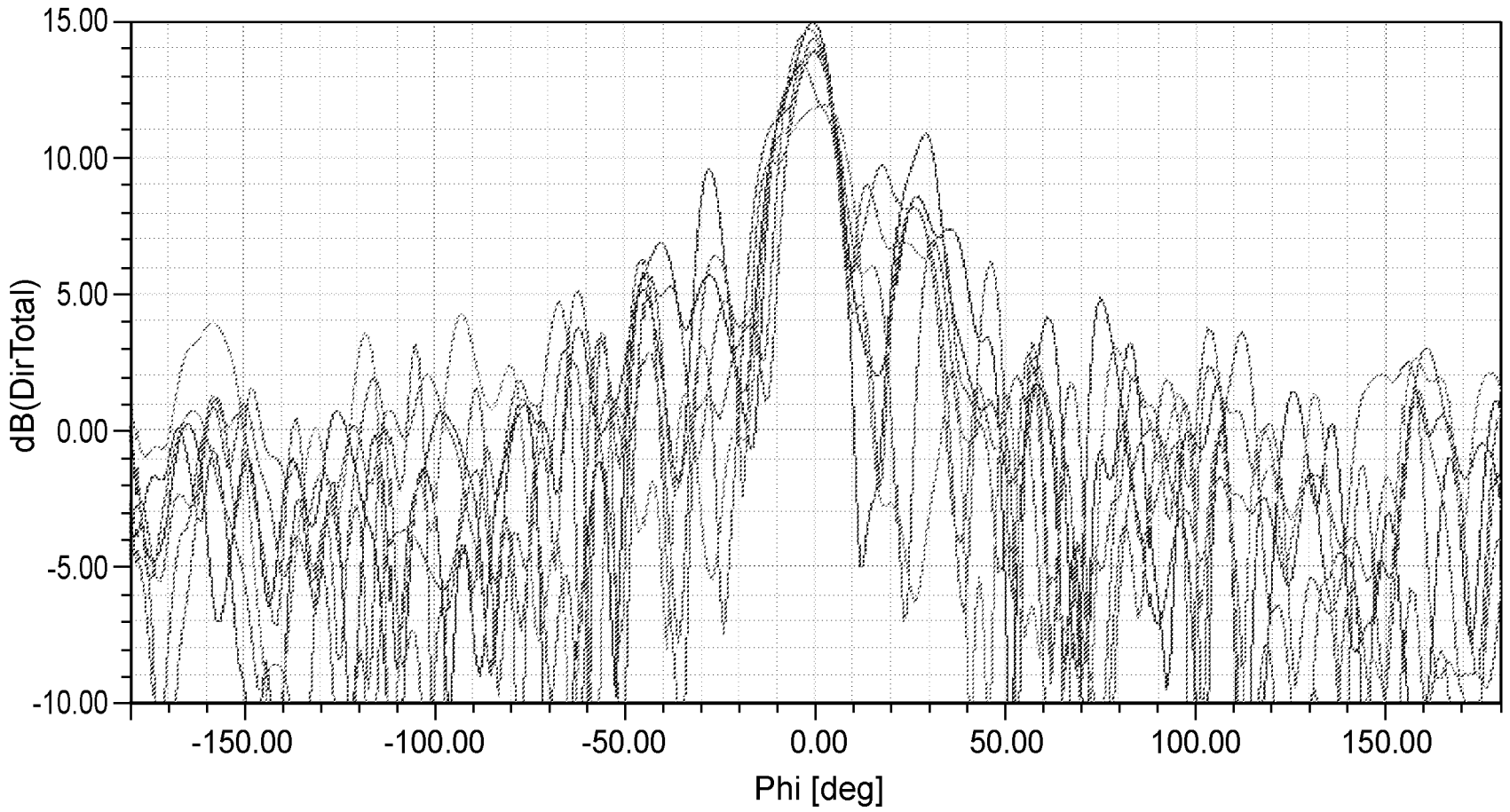
FIG. 3C illustrates the radiation patterns of the antenna of FIG. 1A.

FIG. 3C illustrates the radiations patterns of antenna 100 for different frequencies in the band between 26.5 GHz-29.5 GHz, providing evidence that antenna 100 in the disclosed embodiment delivers a high directivity of about 15 dB in a broad frequency band.

Referring again to FIGS. 1A and 2A, first control layer 101 has an array of vertical-polarization peripheral ports 151 and second control layer 202 has an array of horizontal-polarization peripheral ports 252. Polarization peripheral ports 151 and 252 may for example be designed as described in the cross-referenced application, and are not detailed in the present disclosure. The vertical-polarization peripheral ports 151 and horizontal-polarization peripheral ports 252 are collocated such that both structures may be complementary to each other.

How the coupling may be performed of the RF wave from parallel-plate waveguides 131 and 132 to respectively vertical-polarization peripheral ports 151 and horizontal-polarization peripheral port 252, and vice versa, may be found as described in the cross-referenced application. In addition, bent lines as described below, also form part of such coupling.

The number of vertical-polarization peripheral ports 151 and horizontal-polarization peripheral ports 252 may be determined from the radius of the stack-up structure 110 and a distance between neighboring peripheral ports, either between neighboring vertical-polarization peripheral ports 151 on first control layer 101 or between neighboring horizontal-polarization peripheral ports 252 on second control layer 202. In some embodiments, the distance between vertical-polarization peripheral ports 151 is approximately half of the wavelength. The radius of the stack-up structure 110 is determined by the desired gain and directivity of the antenna 100. For example, and without limitation, the radius of the stack-up structure 110 may be about 70 mm, and the distance between vertical-polarization peripheral ports 151 or between horizontal-polarization peripheral ports 252 may be about 6.87 mm allowing for 64 such peripheral ports.

Referring again to FIG. 1A, FIG. 1B, FIG. 2A, and FIG. 2B, two FSS 191, 292 are located on first control layer 101 and second control layer 202, respectively. Both FSS 191, 292 are integrated with stack-up structure 110 and comprise a plurality of FSEs 600A-600B operatively connected to through vias 130 of stack-up structure 110. As described in more details below, FSEs 600A-600B are arranged in rows 115, 116 and 118 that may be concentric as shown in FIG. 1B, with the FSEs 600A-600B in FSS 191 controlling propagation of the RF wave inside parallel-plate waveguides 131, 132, which are coupled to vertical-polarization peripheral ports 151 through vias and bent lines 123. The same may be implemented with respect to FSEs 600A-600B in FSS 292 and horizontal-polarization peripheral ports 252.

Not only are FSS 191, 292 integrated with stack-up structure 110, they are also integrated with each other because they are both operatively connected to through vias 130 of stack-up structure 110. It should be noted that, in at least one embodiment, vias 130 of antenna 100 are through vias, which is generally cheaper to fabricate than other types of vias.

Figure 4:
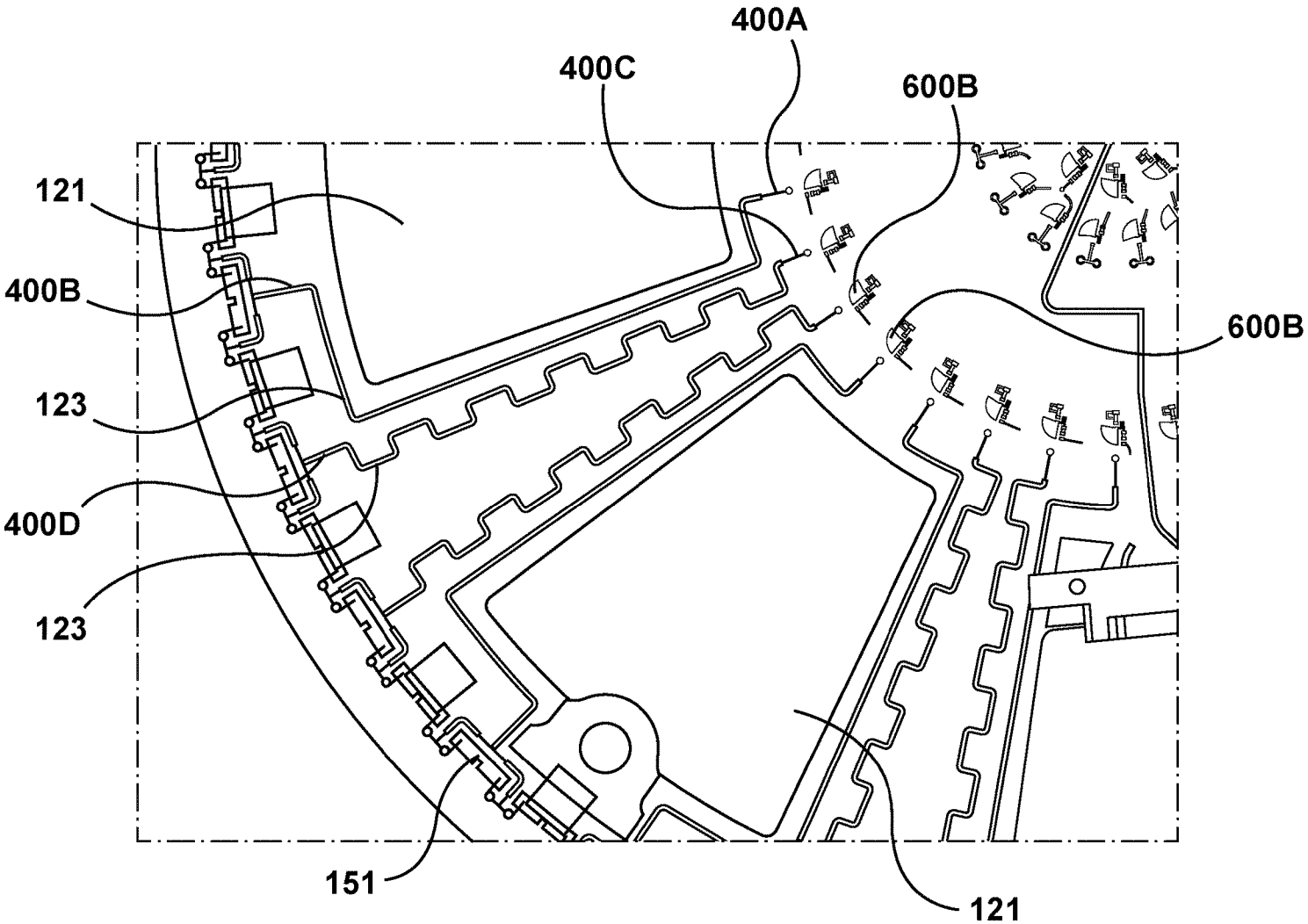
FIG. 4 provides an enlarged top view of bent lines, in an embodiment of the present technology.

FIG. 4 provides an enlarged top view of bent lines 123. As indicated, they couple parallel-plate waveguides 131, 132 to vertical-polarization peripheral ports 151 (and horizontal-polarization peripheral ports 252 in FSS 292). As seen in the embodiment depicted FIG. 4, each bent line 123 in FSS 191 corresponds to two vertical-polarization peripheral ports 151 (and each bent line 123 in FSS 292 corresponds to two horizontal-polarization peripheral ports 252). However each bent line 123 could correspond to a different number of polarization peripheral ports. Bent lines 123 are designed so as to both bypass hollow portions 121, and to offer a high symmetry in transmission coefficients between bent lines, as well as a low coupling between them, in particular adjacent ones. It will be apparent that groupings of more than two bent lines 123 may be had around hollow portions, to the extent still achieving the same objectives of high symmetry and low coupling. In an embodiment of the present technology, bent lines 123 are designed so as to attain the characteristics as shown below in relation to FIGS. 5A-5C. Such characteristics are calculated in relation to four reference points 400*a/b/c/d* at the extremities of two bent lines 123, as shown FIG. 4, the other bent lines 123 featuring identical characteristics owing to the symmetry of shape of the bent lines.

Bent lines 123 may be made of microstrip lines with a width optimized to ensure impedance matching of the full antenna 100 which includes transitions from parallel-plate waveguides 131 and 132 to bent lines 123. As shown FIG. 4, bent lines 123 do not all have the same physical length or shape, but they are shaped so as to provide the same electrical length, at the same time allowing space for integrating DC and RF connectors and features for mechanical assembling. Bent lines 123 may for example be straight microstrip lines, or microstrip lines with a crenellated shape as seen in FIG. 4. It should be noted that bent lines 123 may be advantageously used regardless of whether hollow portions 121 need be bypassed, as they reduce the number of required switchable elements 620 in FSEs 600A-600B.

Figure 5A:
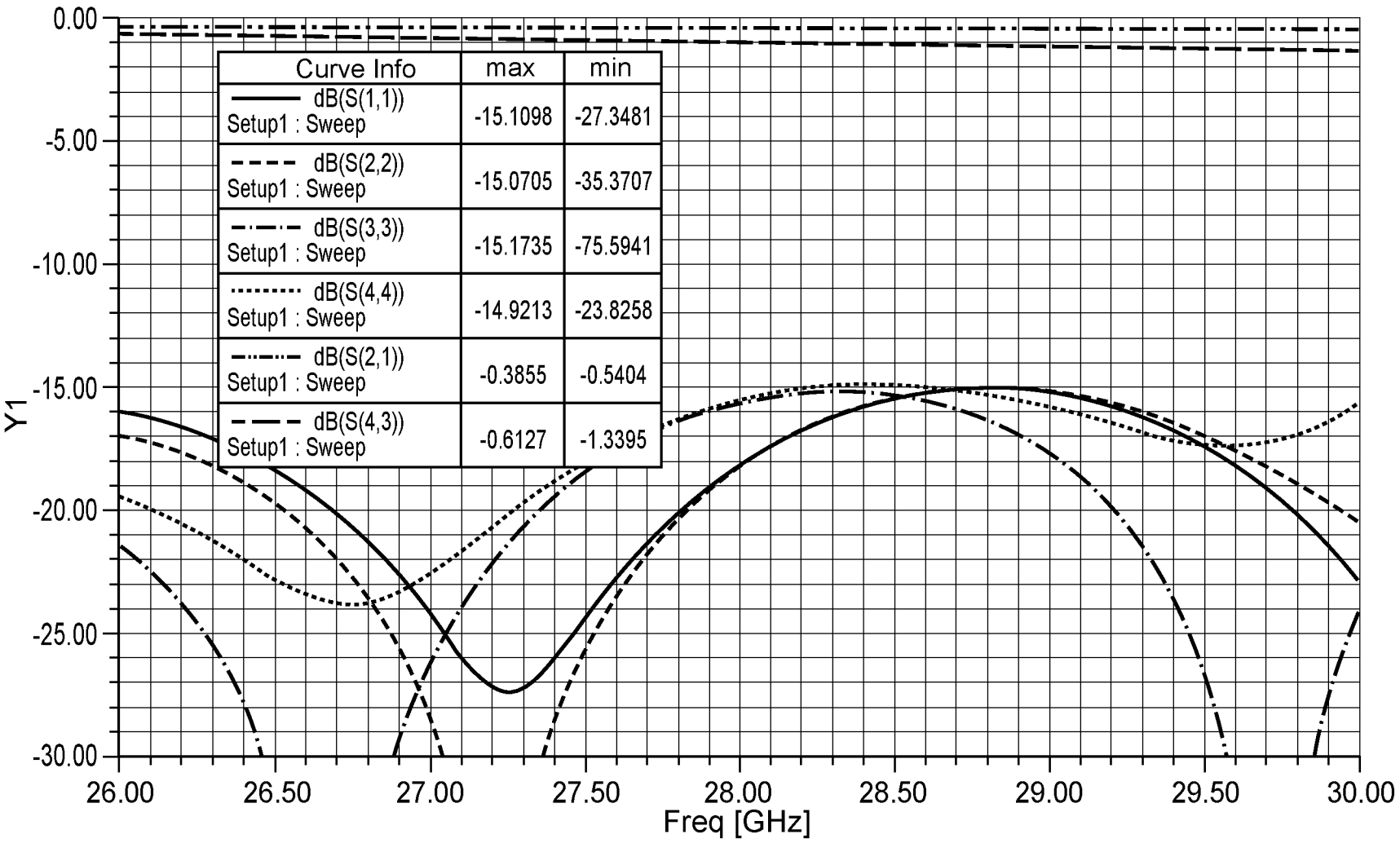
FIG. 5A illustrates the S parameters of the bent lines of FIG. 4.

FIG. 5A illustrates the S parameters of the bent lines 123 in FIG. 4. Reflection coefficients S11, S22, S33 and S44, as measured using the four reference points 400*a/b/c/d* on FIG. 4 as respectively ports 1/2/3/4 for the S parameters, are below −15 dB in the band 26 GHz-30 GHz, providing evidence that the bent lines 123 are well matched in a broad frequency band. Coefficients S21 and S43 are higher than −1.4 dB in the frequency band 26 GHz-30 GHz, providing evidence that bent lines 123 have low insertion losses and good transmission coefficients.

Figure 5B:
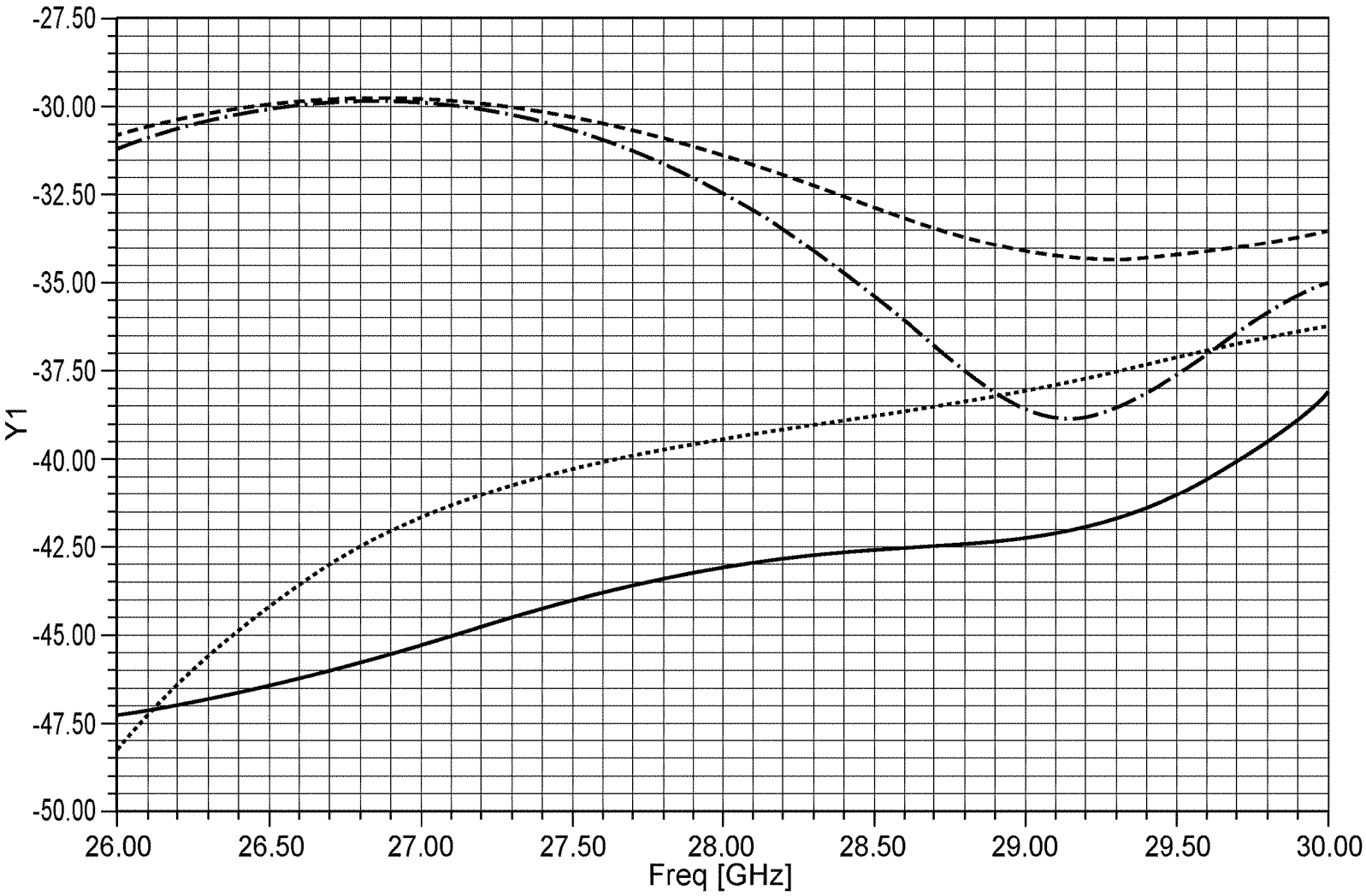
FIG. 5B illustrates the isolation between the bent lines of FIG. 4.

FIG. 5B illustrates the isolation between the bent lines 123 of FIG. 4, as measured using the four reference points 400*a/b/c/d* on FIG. 4. It further illustrates the transmission coefficients for uncoupled ports of the bent lines 123, providing evidence that the coupling coefficients are below −29 dB in a broad frequency band (26 GHz-30 GHz).

Figure 5C:
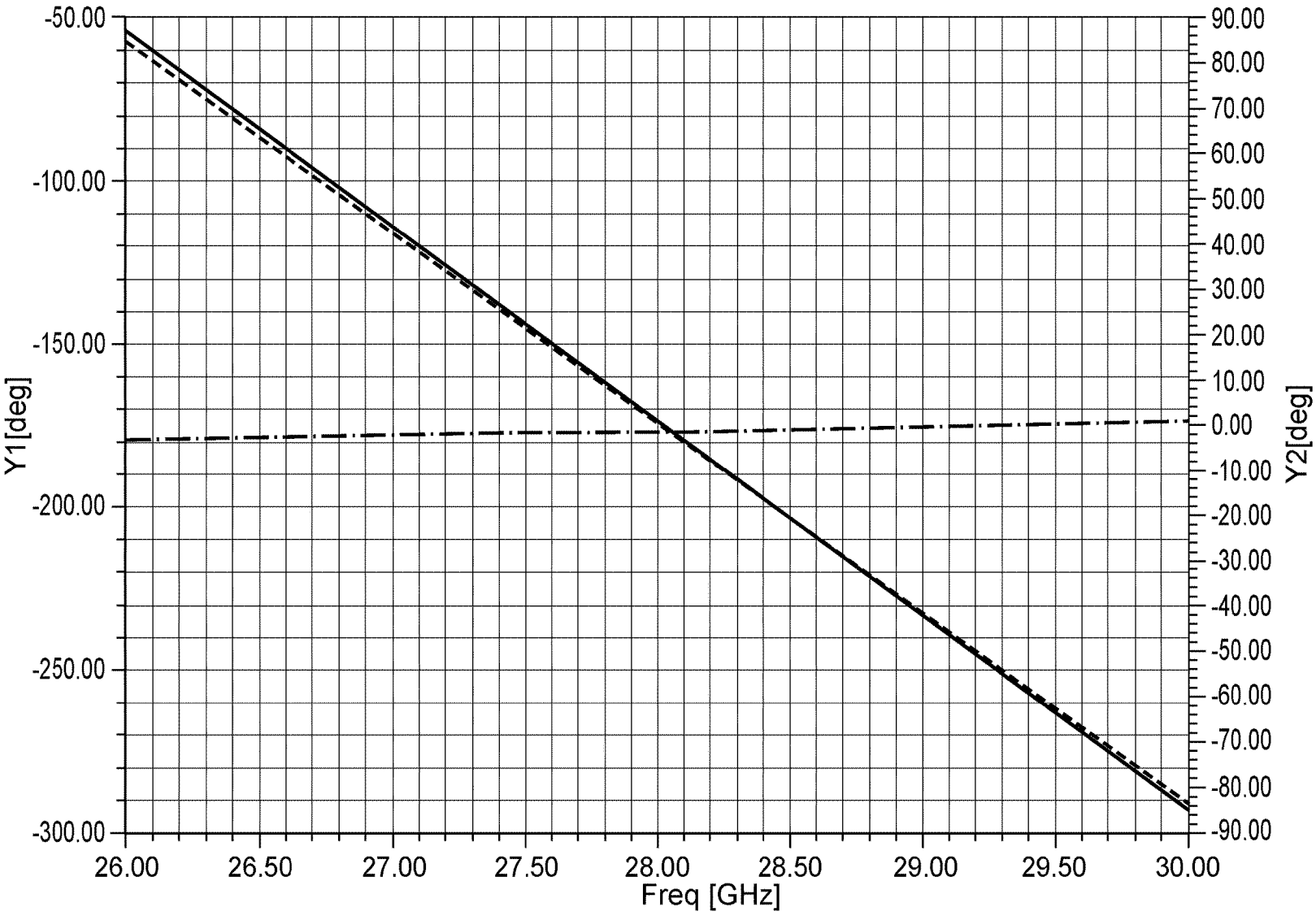
FIG. 5C illustrates the phase of the bent lines of FIG. 4, and the phase difference.

FIG. 5C illustrates the phase of the bent lines 123 of FIG. 4, and the phase difference, as measured using the four reference points 400*a/b/c/d* on FIG. 4. It further illustrates the phases of the transmission coefficients versus frequency for coupled ports of the bent lines 123 of FIG. 4, and the differences of these two phases versus frequency. It shows that the bent lines 123 have the same phase in a broad frequency band (26 GHz-30 GHz). This ensures that the complete antenna 100 will present symmetrical radiation pattern and no scan loss when the RF beam is steered.

The structure of FSE 600B may be as found in the cross-referenced application, and is not detailed further in the present disclosure.

Figure 6A:
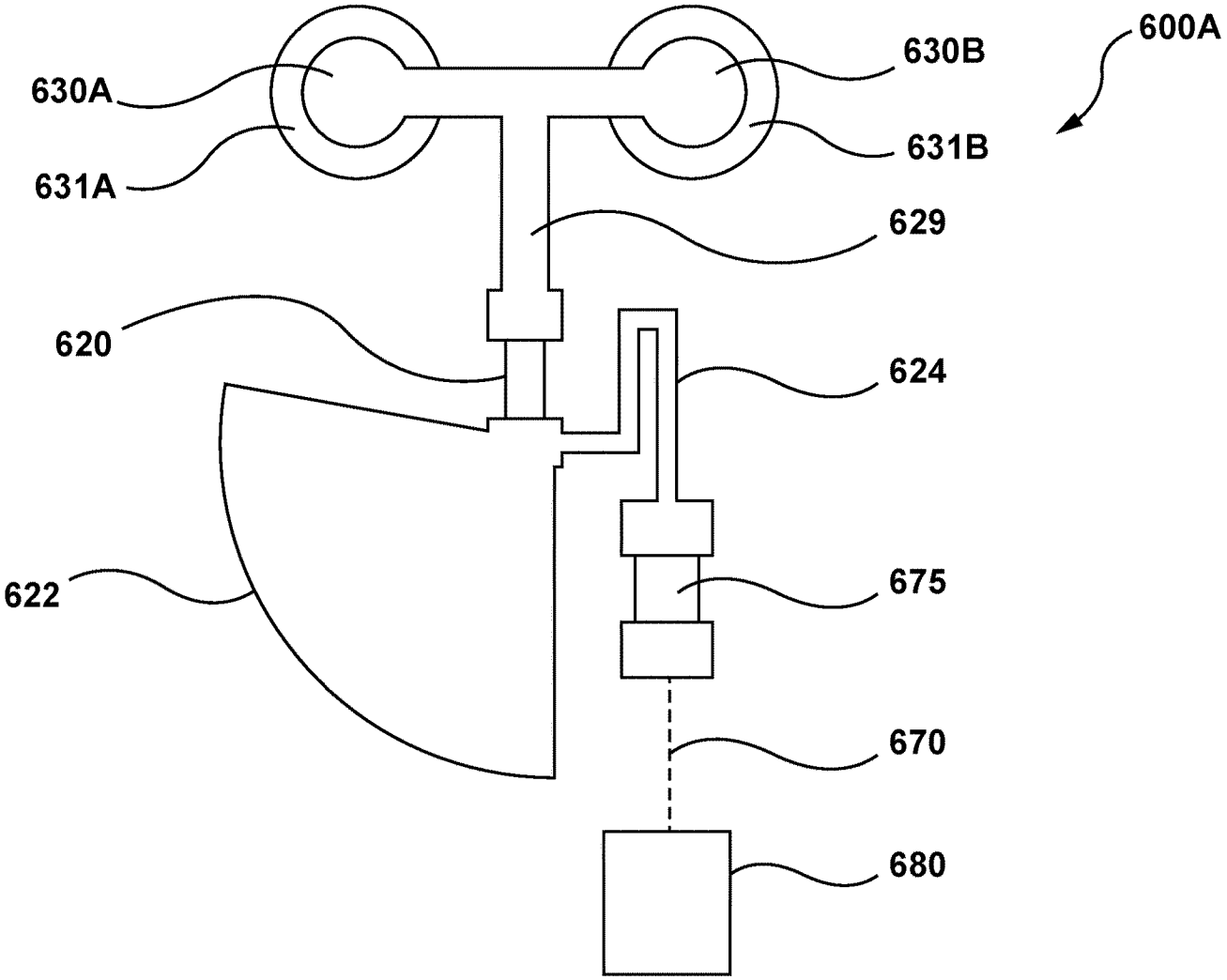
FIG. 6A depicts a top view of a Frequency Selective Element (FSE) in a portion of the antenna of FIG. 1A, in an embodiment of the present technology.

The structure of FSE 600A will now be described in further detail. FIG. 6A depicts a top view of a configuration of FSE 600A in a portion of antenna 100, in accordance with an embodiment of the present disclosure.

The FSE 600A is operably connected to a double via 630A-630B and has a switchable element 620, a radial stub 622, and a direct current (DC) circuit 624. FSE 600A also has a connector stub 629 that operatively connects double via 630A-630B to switchable element 620. Double via 630A-630B passes through two apertures 631A-631B formed in first control layer 101 and metal plates 133, 134, as also more clearly seen on FIG. 6B.

The radial stub 622 is illustrated as an open-ended radial stub. The length of the radial stub is determined by ¼ of the microstrip line guided wavelength ($\lambda_g$). The radial stub 622 may be implemented as any of a microstrip, a substrate integrated waveguide, a stripline, a coplanar waveguide, or the like. The radial stub 622 is configured to choke high frequencies while passing low frequencies. The open-ended radial stub 622 provides a ground to RF signal, while not grounding the DC signal.

The switchable element 620 may be a PIN diode, such as a beam lead PIN diode. In at least one another embodiment, switchable element 620 may be a microelectromechanical systems (MEMS) element.

The switchable element 620 of the FSE 600A is operatively connected to radial stub 622 and to double via 630A-630B. The switchable element 620 may also be connected through DC circuit 624 and DC line 670 to a controller 680.

The controller 680 may be, for example, a DC voltage controller. The DC circuit 624 has a resistor 675, which allows controlling the current of the switchable element 620. The resistor 675 may be a millimeter wave thin film resistor or a regular thick film resistor.

The controller 680 may operate the switchable element 620 that is configured to actuate voltage/current supplied to radial stub 622 and control the operation of switchable element 620 by switching it to ON or OFF operation mode.

When switchable element 620 is in ON operation mode, the switchable element 620 acts as a resistance, equivalent to serial resistance of switchable element 620 (for example, to the serial resistance of the PIN diode). When switchable element 620 is in OFF operation mode, the switchable element 620 acts as a capacitor. When switchable element 620 is in OFF mode, the RF wave continues its propagation in first parallel-plate waveguide 131 or second parallel-plate waveguide 132.

By increasing or decreasing the length of connector stub 629 by a quarter wavelength, one may invert the ON and OFF effect of FSE. That is, when the switchable element 620 is OFF, FSE 600A does not permit (e.g. it prevents) propagation of the RF wave. When switchable element 620 is ON, FSE 600A permits (allows) propagation of the RF wave.

Double via 630A-630B, as opposed to a single via for FSE 600B as shown in the cross-referenced application, increases the reflectivity of FSE 600A when it is in ON operation mode. This in turn improves the ability to control propagation of the RF wave inside the first parallel-plate waveguide 131 or second parallel-plate waveguide 132. The length of connector stub 629 may be adapted (compared for example to a connector stub for FSE 600B as seen in the cross-referenced application) so that FSE 600A may be optimized for the frequency of the RF wave.

Figure 6B:
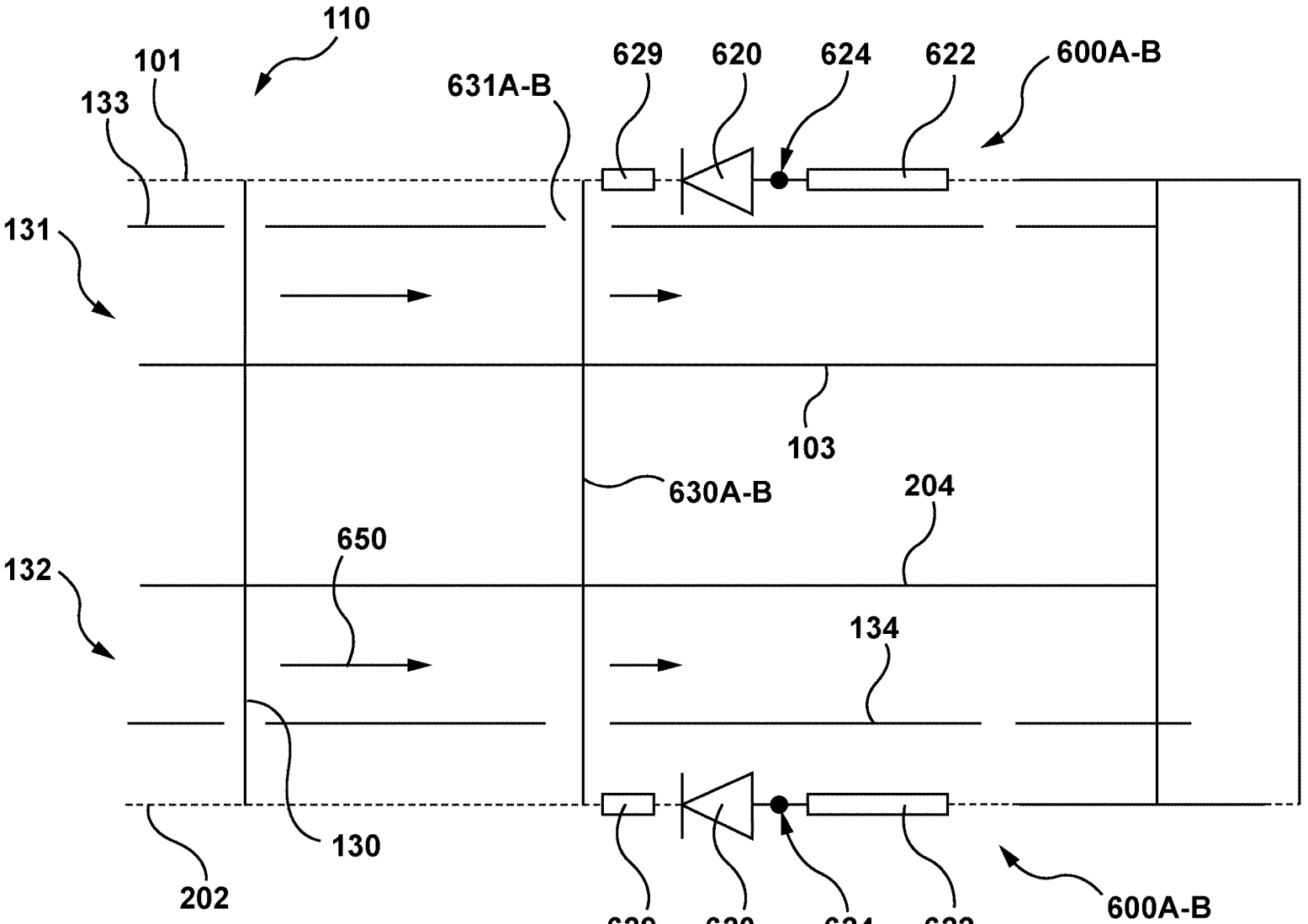
FIG. 6B illustrates an elevation side view of a FSE and a surrounding portion of the antenna of FIG. 1A, in an embodiment of the present technology.

Referring to FIG. 6B, stack-up structure 110 has a first parallel-plate waveguide 131 and a second parallel-plate waveguide 132, ground layers 103, 204, first control layer 101 and second control layer 202, as well as first metal plate 133 and second metal plate 134, as discussed above.

One FSE 600A or 600B is located on first control layer 101 and connected to a double via 630A-630B (or a single via, as shown in the cross-referenced application). Another FSE 600A or 600B is located on an opposite side of stack-up structure 110, i.e. on second control layer 202.

The double via 630A-630B (or single via as shown in the cross-referenced application) is electrically connected to ground layer 103 and passes through two apertures 631A-631B (or a single aperture, as shown in the cross-referenced application) formed in first control layer 101 and metal plates 133, 134 through two other apertures (not shown, or a single aperture, as shown in the cross-referenced application) in second control layer 202 to join FSE 600A or 600B located on the second control layer 202.

On horizontal-polarization surface 202, double via 630A-630B (or single via as shown in the cross-referenced application) is operatively connected to another connector stub 629, which is operatively connected to another switchable element 620, operatively connected to radial stub 622. The switchable element 620 may be also connected through DC circuit 624 to a controller 680.

It should be noted that FSE 600A or 600B on second control layer 202 may be similar to FSE 600A or 600B on first control layer 101, with similar structural elements and parameters.

Each FSE 600A or 600B, and in particular, each switchable element 620 may be operatively connected, through a separate DC connection line 670 to DC controller 480. The controller 680 is configured to control switchable elements 620 by operating each of them between ON and OFF operation modes.

Referring now also to FIG. 1A, FIG. 1B, the FSEs 600A-600B of FSS 191, 292 may be operatively connected to the DC connector 181 (depicted in FIG. 1A), which are then operatively connected to the controller 680 (shown in FIG. 6A). The DC connector 181 may be located proximate to a hollow portion 121. The controller 680 may control beam direction for vertical and horizontal polarizations separately by controlling operation of FSEs 600A-600B and in particular, operation of the switchable elements of FSEs 600A-600B. It should be noted that although each switchable element (such as switchable element 620 shown in FIG. 6A) is connected to the controller 680 with a DC line (such as DC line 670 shown in FIG. 6A), DC lines are not illustrated in FIGS. 1A and 1B to simplify the drawing.

It should be noted that there may be one controller 680 for vertical and horizontal polarizations, or there may be a separate controller 680 for each polarization. It should also be understood that each switchable element of, and therefore each, FSE 600A-600B, may be controlled separately. Alternatively, switchable elements may be grouped as discussed below.

The FSEs 600A-600B are configured to permit propagation of the RF wave when their switchable element is in OFF operation mode. When their switchable element is in ON operation mode, the RF wave is captured by radial stubs (such as radial stub 622 shown in FIG. 6A) and therefore FSEs 600A-600B block the RF wave from further propagation towards the circumferential edge 104 of stack-up structure 110.

In order to determine a configuration of FSE 600A-600B, amplitudes of reflection and transmission coefficients of FSE 600A-600B may be obtained using a rectangular waveguide as disclosed in the cross-referenced application.

Referring again to FIGS. 1B and 2A, FSEs 600A-600B are positioned radially on stack-up structure 110 and are arranged in FSE rows 115, 116 and 118 where each FSE 600A-600B is located radially from central port 105, 206.

Referring to FIGS. 1B, 6A and 6B, connector stub 629 may be made shorter in some of FSEs 600A-600B of FSS 191. In at least one embodiment, one FSS row 115 may have FSEs 600B with longer connector stub 629, while the neighboring row 116 of the same FSS may have FSEs 600A with shorter connector stub 629 compared to row 115. For example, some FSE rows 115 may have one length of connector stubs 629, and the other neighboring rows 116 may have shorter (or longer) length of connector stubs 629 in FSEs 600A-600B. For example, every second FSE row 116 may have FSE 600A-600B with shorter connector stub 629. Such configuration of FSS 191 may result in smooth transmission characteristics over a broad frequency bandwidth of antenna 100. In addition to their different length, the connector stub 629 can also have different microstrip line widths. While FSEs 600B may be located in rows 115 and 118, and FSEs 600A in row 116, other distributions of FSEs 600A/600B may be had among the different rows 115, 116 and 118. For example, FSEs may all be of one type, 600A or 600B, FSEs 600A may be located in rows 118, etc.

Referring to FIG. 1B, the number of FSE rows 115, 116, 118, and distances 117A and 117B between perimeters of respectively rows 118 and 116, and rows 116 and 115, may be optimized for desired RF characteristics of antenna 100, for example: the total gain of the antenna 100 versus frequency such as the one illustrated on FIG. 3A, and antenna 100 radiation patterns such as the ones illustrated on FIG. 3C. In the embodiment shown FIG. 1B, FSS 191 comprises three rows 115, 116, and 118, but a different number of rows could form FSS 191. In particular, if one increases the radius of stack-up structure 110, the number of FSE rows 115, 116, 118 may be increased. In some embodiments, the distance 117 between FSE rows 118, 116 may vary and may be longer towards the center port 105, 206 and shorter towards peripheral ports 151, 252.

In operation, antenna 100 may be steered by switching ON and OFF the switchable elements 620 of FSEs 600A-600B. The switchable elements 620 are operated by controller 680. The RF wave is transmitted when switchable elements 620 are in OFF operation mode and reflected when the switchable elements 620 are in ON operation mode. As disclosed in the cross-referenced application, FSEs 600A-600B which are located inside a particular area (not shown in the present disclosure) may be operated simultaneously and switched ON and OFF by a controller (not shown), the particular area's characteristics being determined based on various parameters, such as, for example, a desired gain, a steering angle, and a desired beam width. Various combinations of grouping and selective switching of FSEs 600A-600B of antenna 100 may permit steering the beam with a beam-steering step of as low as 3 degrees. As also disclosed in the cross-referenced application, antenna 100 may transmit RF wave to various directions simultaneously by switching OFF several particular areas, therefore becoming a multi-directional antenna.

Figure 7:
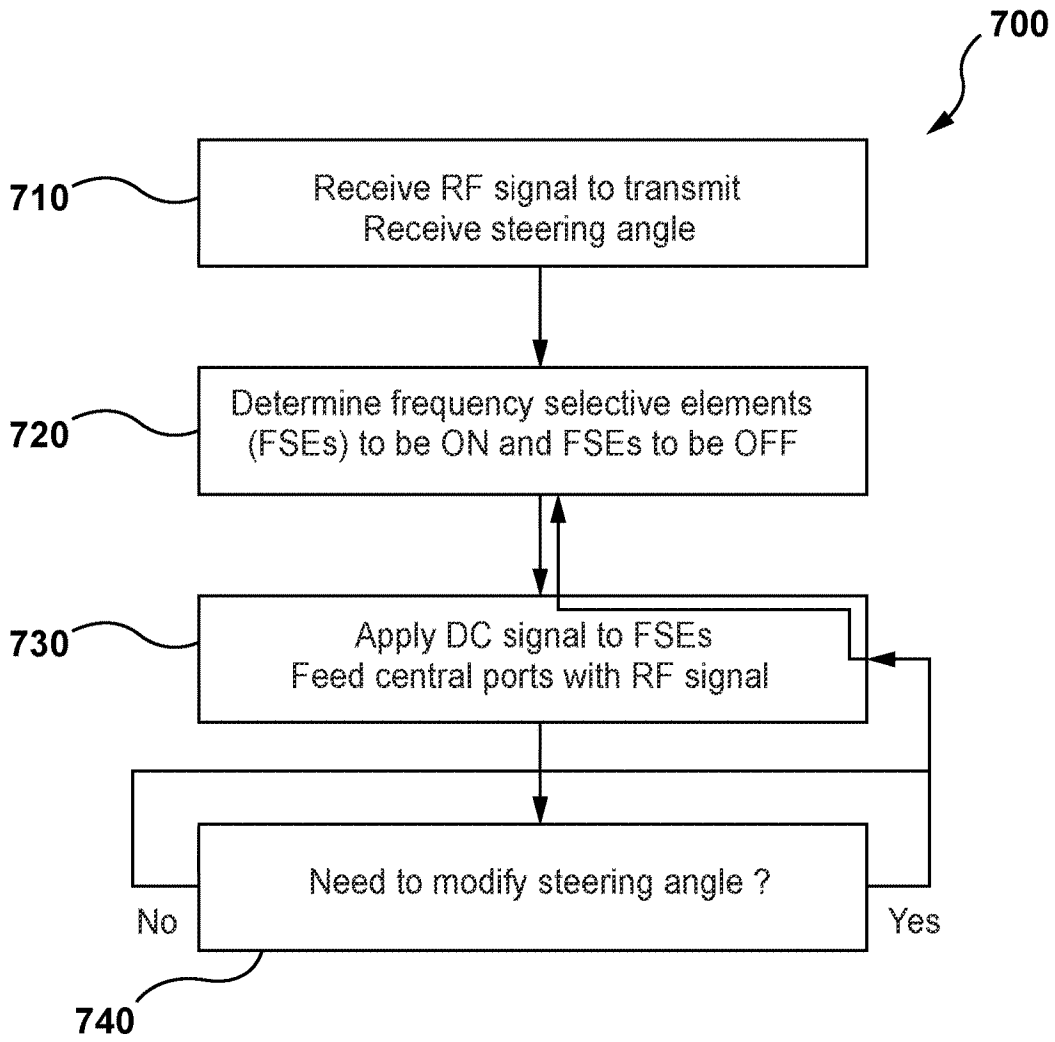
FIG. 7 illustrates a method of steering electromagnetic beam transmitted by the antenna of FIG. 1A, in an embodiment of the present technology.

FIG. 7 illustrates a method 700 of steering RF beam transmitted by antenna 100, in an embodiment of the present technology. At task block 710, a controller (for example, a RF controller, or a RF controller combined with a DC controller) may receive an externally provided steering angle and RF signal for transmission by antenna 100. The controller then determines at task block 720 FSEs 600A-600B that need to be ON and FSEs 600A-600B that need to be OFF in order to transmit the RF signal at the provided steering angle. Polarization of radiated RF wave may also be determined by the controller at this task block 710.

DC signal is then applied at task block 730 to FSEs 600A-600B of antenna 100 such that some FSEs 600A-600B are ON and the others are OFF, as determined previously by the controller. At the same time as the appropriate DC signal is applied to FSEs 600A-600B, RF signal is applied to one central port 105 or 206. As discussed above, the polarization of the transmitted RF wave may be controlled by supplying the RF signal to the central port, i.e. either to the central port located on first control circuit layer 101 or on second control circuit layer 202.

In order to modify at task block 740 the steering angle, the controller needs to determine 720 again the appropriate number of FSEs 600A-600B that need to be OFF, as well as their location. The other FSEs 600A-600B may be turned ON by the controller. As discussed above, the polarization of radiated RF wave may be controlled by supplying RF signal to either one or another central port 105, 206.

When implemented using a PCB, antenna 100 may be integrated on one substrate, that is stack-up structure 110, using low-cost multilayer PCB manufacturing process. Several multilayer PCBs may be stacked together. This may aid in either or both of increasing total gain and improving the control of beam direction in elevation.

Figure 8:
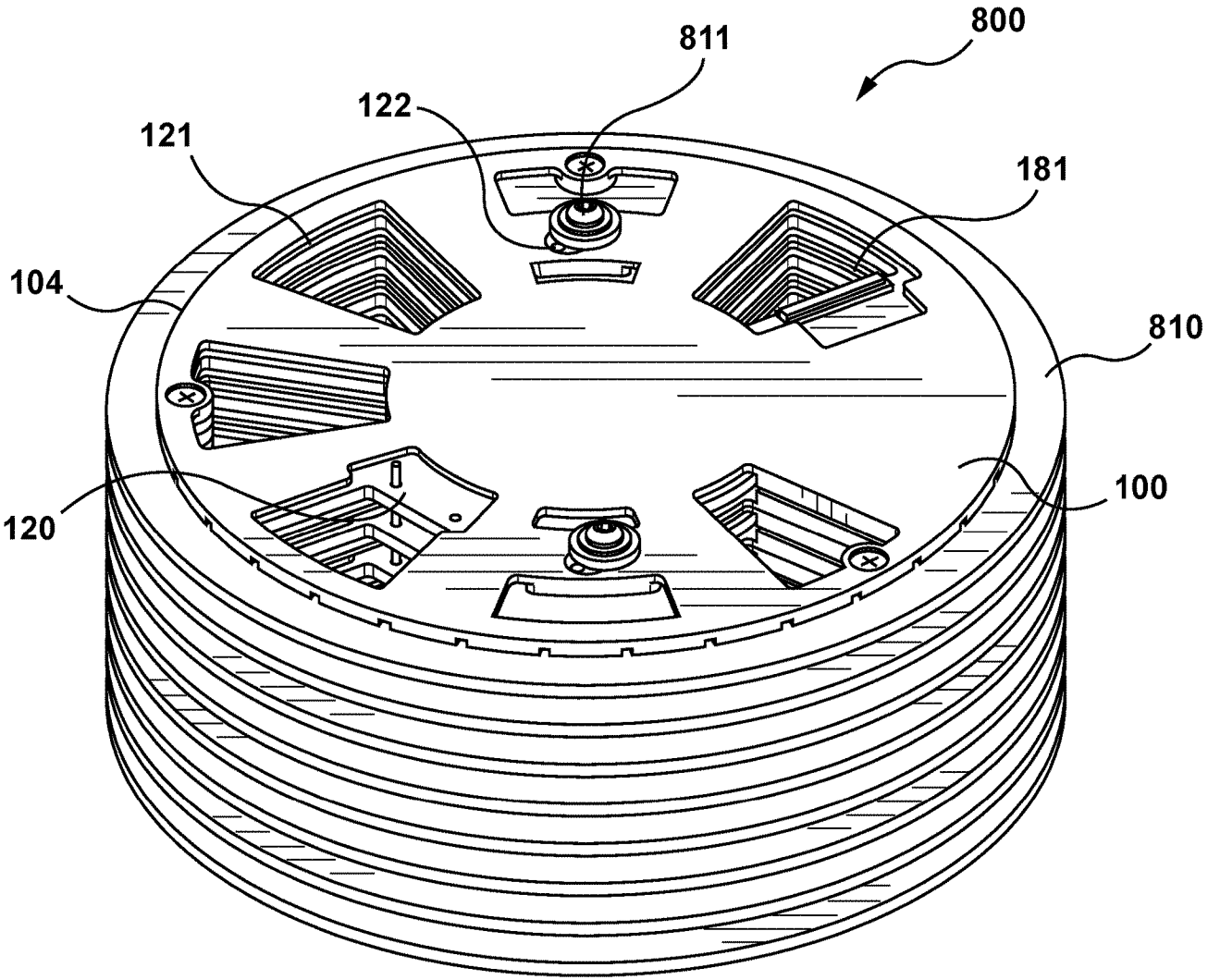
FIG. 8 depicts a stacked antenna, in an embodiment of the present technology.

FIG. 8 depicts a stacked antenna 800, in an embodiment of the present technology. In stacked antenna 800, several antennas 100 are stacked together. Eight are shown on FIG. 8 but a different number may be used. In particular, stacked antenna 800 may be built when stack-up structure 110 of antennas 100 is made of PCB. Due to integration of the elements of antennas 100 with stack-up structure 110, such antenna 800 may remain compact.

Protective layers 810 may be provided between neighboring antennas 100 of stacked antenna 800. The protective layers 810 may help to reduce energy coupling between the FSSs (not depicted in FIG. 8) of the neighboring antennas 100. The protective layer 810 may be made of a metal material, for example, aluminum.

When antennas 110 are stacked-up, hollow portions 121, and holes 122 may be aligned, to allow mechanically maintaining (fixing and/or positioning) the stacked-up antennas 110, such as for example through the use of screws 811 through holes 122.

Alignment of hollow portions 121, and holes 122 further allows to electrically feed RF connector 120 and DC connector 181, from the inside of circumferential edge 104 of antennas 110. DC connectors 181 of antennas 100 may be connected to a master controller (not shown), which may be configured to operate the FSSs 191-292 of antennas 100, and in particular, their switchable elements. Operation of FSSs 191-292 and of FSEs 600A-600B may or may not be independent or asynchronous from one stacked antenna 100 to the next. This allows to have a single steered RF beam with all stacked up antennas 100, or up to as many independent steered RF beams as there are stacked up antennas 100. For example between 1 and 8 different RF beams may be transmitted with the stacked up structure of FIG. 8, when multiple RF beams may not be had with a single antenna 100, having an optimized impedance matching for a single RF beam. Grouping certain of antennas 100 in the stack to share the same synchronous operation of their FSSs 191-292 and FSEs 600A-600B may provide a higher gain for a particular steered RF beam.

Figure 9:
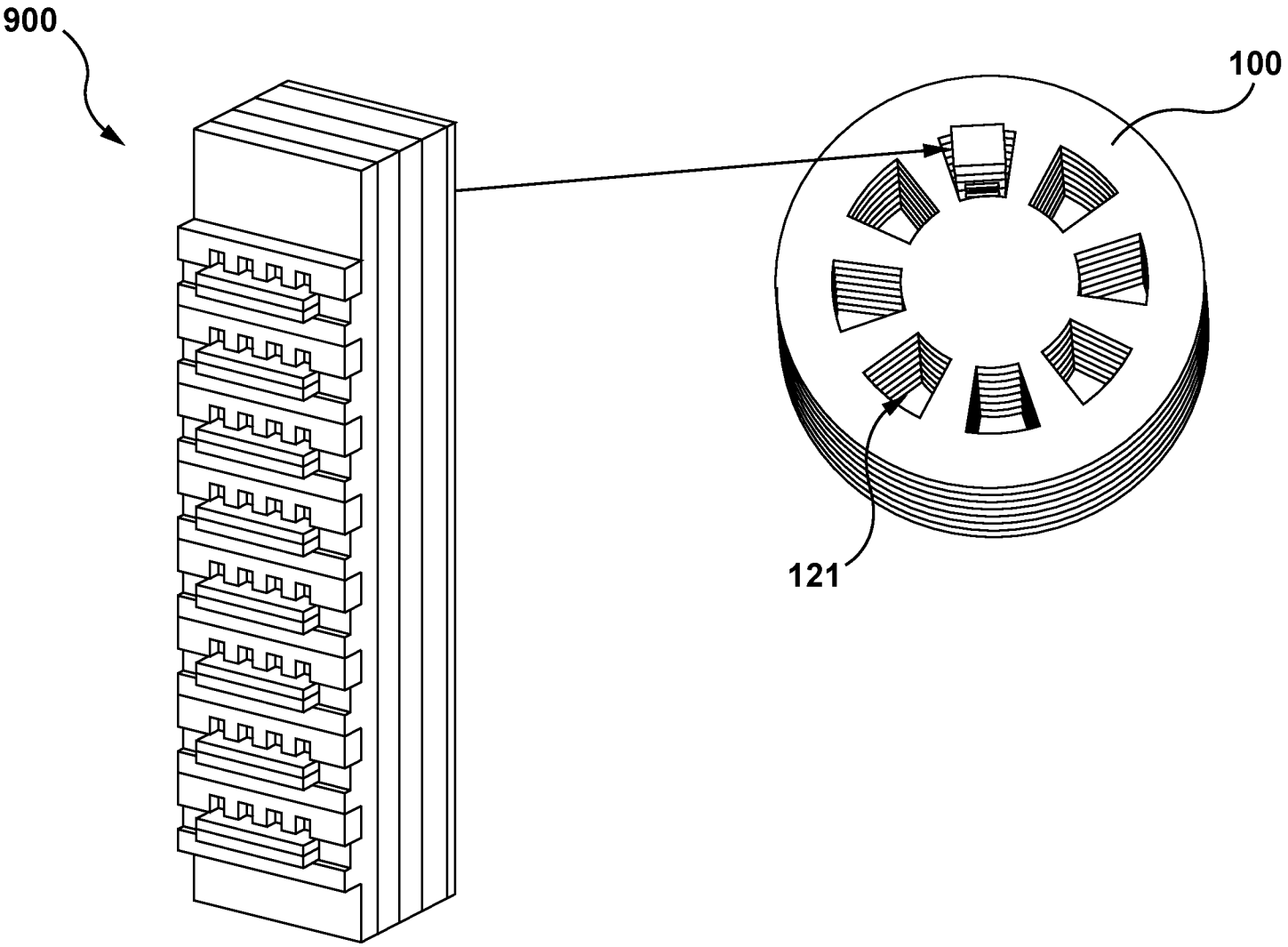
FIG. 9 depicts a RF power divider and its insertion through hollow portions of the structure of the stacked antenna.

Conversely, as shown FIG. 9, RF connectors 120 of antennas 100 may be operatively connected to a RF power divider 900 that is configured to feed the central ports (not depicted in FIG. 9) of antennas 100. RF power divider 900 may be inserted through one of the hollow portions 121, and electrically and mechanically attach to each one of the RF connectors (not shown) of antennas 100.

It is to be understood that the operations and functionality of at least some components of the disclosed antenna may be achieved by hardware-based, software-based, firmware-based elements and/or combinations thereof. Such operational alternatives do not, in any way, limit the scope of the present disclosure.

It will also be understood that, although the inventive concepts and principles presented herein have been described with reference to specific features, structures, and embodiments, it is clear that various modifications and combinations may be made without departing from the such disclosures. The specification and drawings are, accordingly, to be regarded simply as an illustration of the inventive concepts and principles as defined by the appended claims, and are contemplated to cover any and all modifications, variations, combinations or equivalents that fall within the scope of the present disclosure.

What is claimed is:

1. An antenna for transmission of a radio-frequency (RF) wave, the antenna comprising:

a stack-up structure having:

a first control layer;

a second control layer being approximately parallel to the first control layer;

a first parallel-plate waveguide and a second parallel-plate waveguide located between the first control layer and the second control layer, the first parallel-plate waveguide and the second parallel-plate waveguide being approximately parallel to each other and to the first control layer and the second control layer;

a plurality of through vias operatively connecting the first control layer and the second control layer to center RF and direct current (DC) ground planes;

one or a plurality of hollow portions through the stack-up structure; and a RF connector being proximate to a hollow portion, and configured to deliver a RF signal to a first central port located on the first control layer and a second central port located on the second control layer; the first central port being configured to radiate the RF wave into the first parallel-plate waveguide, and the second central port being configured to radiate the RF wave into the second parallel-plate waveguide;

vertical-polarization peripheral ports integrated with the first control layer and configured to radiate the RF wave in vertical polarization from the first parallel-plate waveguide; and horizontal-polarization peripheral ports integrated with the second control layer and configured to radiate the RF wave in horizontal polarization from the second parallel-plate waveguide, each one of the vertical-polarization peripheral ports being collocated with one of the horizontal-polarization peripheral ports such that they cross each other, and that a RF wave radiation beam may be steered at an angle of 0 to 360 degrees in the plane of the stack-up structure, around the first and second central port.

2. The antenna of claim 1 wherein the stack-up structure has an approximately circular shape.

3. The antenna of claim 1 wherein the stack-up structure has an approximately elliptical shape.

4. The antenna of claim 1, further comprising:

a pair of frequency selective structures having frequency selective elements, each frequency selective structure being located partly on a corresponding one of the first control layer or the second control layer, each frequency selective element being configured:

to allow propagation of the RF wave in one of the first parallel-plate waveguide or the second parallel-plate waveguide when the frequency selective element is in one operational mode and to forbid propagation of the RF wave in one of the first parallel-plate waveguide or the second parallel-plate waveguide when the frequency selective element is in another operational mode.

5. The antenna of claim 4, further comprising:

a pair of bent line structures having bent lines, each bent line structure being located partly on a corresponding one of the first control layer or the second control layer, each bent line being configured to bypass the one or the plurality of hollow portions of the stack-up structure, each bent line located on the first control layer being configured to couple the first parallel-plate waveguide to one or a plurality of vertical-polarization peripheral ports, and each bent line located on the second control layer being configured to couple the second parallel-plate waveguide to one or a plurality of horizontal-polarization peripheral ports.

6. The antenna of claim 5, wherein all bent lines in each bent line structure have approximately the same electrical length.

7. The antenna of claim 4, wherein each frequency selective element comprises:

a radial stub configured to choke high frequencies while passing low frequencies; and a switchable element operatively connected to the radial stub and one of the first parallel-plate waveguide or the second parallel-plate waveguide by one or two of the plurality of through vias, the switchable element configured to selectively control operational mode of the frequency selective element.

8. The antenna of claim 7, configured to steer the RF wave radiation beam by selectively switching between one and the other operational mode of the frequency selective elements and by selectively switching on a first plurality of frequency selective elements and switching off a second plurality of frequency selective elements.

9. The antenna of claim 7, wherein each switchable element further comprises a connector stub, the connector stub being configured to operatively connect the switchable element to the one or two of the plurality of through vias, and at least certain of the frequency selective elements have a connector stub being shorter than connector stubs of the other frequency selective elements.

10. The antenna of claim 4, wherein the frequency selective elements of at least one frequency-selective structure of the pair of frequency-selective structures are arranged in rows, each frequency selective element in each row being located at approximately equal distance from the central port located on the same surface as the at least one frequency-selective structure of the pair of frequency selective structures.

11. The antenna of claim 10, wherein the frequency selective elements of at least one frequency-selective structure of the pair of frequency-selective structures are arranged in three rows approximately concentric around the central port located on the same surface as the at least one frequency-selective structure of the pair of frequency selective structures.

12. The antenna of claim 10, wherein the frequency selective elements of at least one frequency-selective structure of the pair of frequency-selective structures are arranged in at least two rows approximately concentric around the central port located on the same surface as the at least one frequency-selective structure of the pair of frequency selective structures, and each switchable element in at least one of the at least two rows further comprises a connector stub, the connector stub configured to operatively connect the switchable element to one of the plurality of through vias, and each switchable element in at least another one of the at least two rows further comprises a connector stub, the connector stub configured to operatively connect the switchable element to two of the plurality of through vias.

13. The antenna of claim 4, wherein at least two of the frequency selective elements are operatively connected to one DC circuit and are operated simultaneously.

14. The antenna of claim 4, wherein the antenna is one of a plurality of antennas, and frequency selective elements of each one of the plurality of antennas are configured to be selectively switched ON and OFF, such that the frequency selective elements of each one of the plurality of antennas may operate synchronously or asynchronously with the frequency selective elements of the other ones of the plurality of antennas.

15. The antenna of claim 14, further configured to steer the RF wave radiation beam, the steering being provided by selectively switching on a first plurality of frequency selective elements of the antenna and switching off a second plurality of frequency selective elements of the antenna.

16. The antenna of claim 14, wherein the plurality of antennas comprises protective layers located between neighboring antennas.

17. The antenna of claim 14, wherein a RF power divider is configured to be inserted through one of the one or the plurality of hollow portions, and to electrically and mechanically attach to the RF connector of each one of the plurality of antennas.

18. An antenna for transmission of a radio-frequency (RF) wave, the antenna comprising:

a stack-up structure having:

a first control layer;

a second control layer being approximately parallel to the first control layer;

a first parallel-plate waveguide and a second parallel-plate waveguide located between the first control layer and the second control layer, the first parallel-plate waveguide and the second parallel-plate waveguide being approximately parallel to each other and to the first control layer and the second control layer;

a plurality of through vias operatively connecting the first control layer and the second control layer to center RF and direct current (DC) ground planes; and a RF connector configured to deliver a RF signal to a first central port located on the first control layer and a second central port located on the second control layer; the first central port being configured to radiate the RF wave into the first parallel-plate waveguide, and the second central port being configured to radiate the RF wave into the second parallel-plate waveguide;

vertical-polarization peripheral ports integrated with the first control layer and configured to radiate the RF wave in vertical polarization from the first parallel-plate waveguide; and horizontal-polarization peripheral ports integrated with the second control layer and configured to radiate the RF wave in horizontal polarization from the second parallel-plate waveguide, each one of the vertical-polarization peripheral ports being collocated with one of the horizontal-polarization peripheral ports such that they cross each other, and wherein the antenna further comprises a pair of bent line structures having bent lines, each bent line structure being located partly on a corresponding one of the first control layer or the second control layer, each bent line located on the first control layer being configured to couple the first parallel-plate waveguide to one or a plurality of vertical-polarization peripheral ports, and each bent line located on the second control layer being configured to couple the second parallel-plate waveguide to one or a plurality of horizontal-polarization peripheral ports.

19. The antenna of claim 18 wherein each bent line is made of microstrip lines with a width optimized to ensure impedance matching of the antenna including transition of one of the first parallel-plate waveguide or the second parallel-plate waveguide to the bent line.

20. The antenna of claim 18 wherein all bent lines have the same electrical length.

* * * * *